US010737499B2

(12) United States Patent
Hayashi

(10) Patent No.: US 10,737,499 B2
(45) Date of Patent: Aug. 11, 2020

(54) LIQUID-CONSUMPTION APPARATUS HAVING SEMIPERMEABLE MEMBRANE POSITIONED IN STORAGE CHAMBER OF TANK AT POSITION AVOIDING WETTING

(71) Applicant: BROTHER KOGYO KABUSHIKI KAISHA, Nagoya-shi, Aichi-ken (JP)

(72) Inventor: Masahiro Hayashi, Nagoya (JP)

(73) Assignee: BROTHER KOGYO KABUSHIKI KAISHA

( * ) Notice: Subject to any disclaimer, the term of this patent is extended or adjusted under 35 U.S.C. 154(b) by 0 days.

(21) Appl. No.: 16/047,878

(22) Filed: Jul. 27, 2018

(65) Prior Publication Data

US 2019/0030906 A1 Jan. 31, 2019

(30) Foreign Application Priority Data

Jul. 31, 2017 (JP) ..... 2017-148681

(51) Int. Cl.

| | |
|---|---|
| ***B41J 2/175*** | (2006.01) |
| ***B41J 29/13*** | (2006.01) |
| ***B41J 2/165*** | (2006.01) |
| ***B41J 29/02*** | (2006.01) |

(52) U.S. Cl.

CPC ..... *B41J 2/17533* (2013.01); *B41J 2/16517* (2013.01); *B41J 2/175* (2013.01); *B41J 2/1752* (2013.01); *B41J 2/1753* (2013.01); *B41J 2/17509* (2013.01); *B41J 2/17513* (2013.01); *B41J 2/17523* (2013.01); *B41J 2/17546* (2013.01); *B41J 2/17553* (2013.01); *B41J 2/17566* (2013.01); *B41J 29/02* (2013.01); *B41J 29/13* (2013.01); *B41J 2202/02* (2013.01)

(58) Field of Classification Search

CPC .... B41J 2/175; B41J 2/17503; B41J 2/17506; B41J 2/17509; B41J 2/17513; B41J 2/1752; B41J 2/17523; B41J 2/17553; B41J 2/17556; B41J 2/17566

See application file for complete search history.

(56) References Cited

U.S. PATENT DOCUMENTS

2008/0204488 A1* 8/2008 Usui ..... B41J 2/17513 347/7

2008/0239028 A1* 10/2008 Umeda ..... B41J 2/17509 347/85

FOREIGN PATENT DOCUMENTS

JP 2008-213162 A 9/2008

* cited by examiner

*Primary Examiner* — Scott A Richmond

(74) *Attorney, Agent, or Firm* — Merchant & Gould P.C.

(57) ABSTRACT

A liquid consumption device includes a cartridge, a tank and a consumption portion. The cartridge includes a first storage chamber. The tank includes a second storage chamber and a semipermeable membrane. The semipermeable membrane covers the communication port. The semipermeable membrane is configured to block a liquid. The semipermeable membrane is positioned above a level of the liquid stored in the first storage chamber in a state where the level of the liquid stored in the first storage chamber becomes equal to the level of the liquid stored in the second storage chamber because of a flow of the liquid from the first storage chamber to the second storage chamber due to water head difference as a result of the connection of the cartridge to the tank. The first storage chamber of the cartridge to connected to the tank stores therein a maximum amount of liquid.

13 Claims, 11 Drawing Sheets

LIQUID-CONSUMPTION APPARATUS HAVING SEMIPERMEABLE MEMBRANE POSITIONED IN STORAGE CHAMBER OF TANK AT POSITION AVOIDING WETTING

CROSS REFERENCE TO RELATED APPLICATION

This application claims priority from Japanese Patent Application No. 2017-148681 filed Jul. 31, 2017. The entire content of the priority application is incorporated herein by reference.

TECHNICAL FIELD

The present disclosure relates to a liquid consumption apparatus provided with a tank supplied with liquid from a cartridge.

BACKGROUND

There is conventionally known, as an example of the liquid consumption apparatus, an inkjet recording apparatus including a main body and a cartridge. The main body includes a tank that can store ink therein and a head supplied with ink from the tank. The cartridge is detachably attached to the main body and is configured to supply ink stored therein to the tank.

In an inkjet recording apparatus disclosed in United States Patent Application Publication No. 2008/0204488A1, an atmosphere opening port is formed in a cartridge and a tank so as to allow an ink storage chamber defined in each of the cartridge and the tank to communicate with an atmosphere so as to supply ink from the cartridge to tank by water head difference.

SUMMARY

In the inkjet recording apparatus disclosed in the Japanese Publication, in order to prevent ink stored in the ink chamber of the tank from leaking through the atmosphere opening port, a configuration may be conceivable in which a semipermeable membrane is disposed in a flow channel connecting the ink chamber of the tank and the atmosphere opening port of the tank. The semipermeable membrane blocks distribution of liquid and allows the atmosphere to pass therethrough.

However, the semipermeable membrane may be dampened depending on the position of the semipermeable membrane due to the contact with the ink. When the semipermeable membrane gets wet, air permeability may be degraded.

It is therefore, an object of the present disclosure to provide an arrangement capable of restraining the semipermeable membrane from getting wetting due to contact with liquid.

This and other objects will be attained by providing a liquid consumption device including a cartridge, a tank and a consumption portion. The cartridge includes a first storage chamber and a first air communicating portion. The first storage chamber is configured to store therein a liquid. The first air communicating portion allows the first storage chamber to communicate with an atmosphere. The cartridge is connectable to the tank. The tank includes a second storage chamber, a second air communicating portion and a semipermeable membrane. The second storage chamber is configured to store therein the liquid flowing from the first storage chamber. At least a part of the second storage chamber is defined by a wall in which a communication port is formed. The second air communicating portion allows the second storage chamber to communicate with the atmosphere through the communication port. The semipermeable membrane covers the communication port. The semipermeable membrane is configured to block the liquid and allow the air to pass therethrough. The consumption portion is configured to consume the liquid supplied from the second storage chamber. The semipermeable membrane is positioned above a level of the liquid stored in the first storage chamber in a state where the level of the liquid stored in the first storage chamber becomes equal to the level of the liquid stored in the second storage chamber because of a flow of the liquid from the first storage chamber to the second storage chamber due to water head difference as a result of the connection of the cartridge to the tank. The first storage chamber of the cartridge to be connected to the tank stores therein a maximum amount of liquid.

According to another aspect, the disclosure provides a liquid consumption device including a cartridge, a tank, a head and a purge mechanism. The cartridge includes a first storage chamber and a first air communicating portion. The first storage chamber is configured to store therein a liquid. The first air communicating portion allows the first storage chamber to communicate with an atmosphere. The cartridge is connectable to the tank. The tank includes a second storage chamber, a second air communicating portion and a semipermeable membrane. The second storage chamber is configured to store therein the liquid flowing from the first storage chamber. At least a part of the second storage chamber is defined by a wall in which a communication port is formed. The second air communicating portion allows the second storage chamber to communicate with the atmosphere through the communication port. The semipermeable membrane covers the communication port. The semipermeable membrane is configured to block the liquid and allow the air to pass therethrough. The head includes a nozzle. The nozzle is configured to eject the liquid supplied from the second storage chamber. The purge mechanism is configured to suck the liquid from the head. The semipermeable membrane is positioned above a level of the liquid stored in the first storage chamber in a state where the level of the liquid stored in the first storage chamber becomes equal to the level of the liquid stored in the second storage chamber because of a flow of the liquid between the first storage chamber and the second storage chamber due to water head difference, after the cartridge whose first storage chamber stores therein a maximum amount of liquid is connected to the tank and after the purge mechanism performs initial purging to suck the liquid in the first storage chamber and the second storage chamber into the head.

BRIEF DESCRIPTION OF THE DRAWINGS

The particular features and advantages of the embodiment as well as other objects will become apparent from the following description taken in connection with the accompanying drawings, in which.

DETAILED DESCRIPTION

Figure 1A:
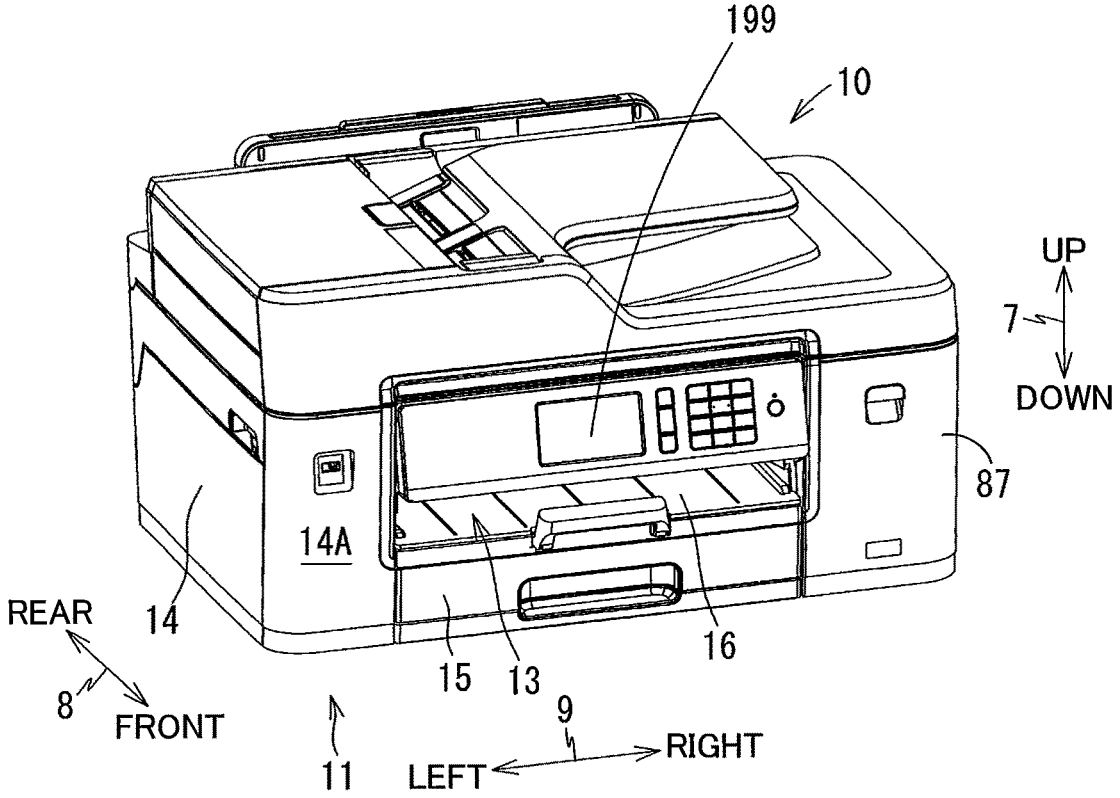
FIG. 1A is a perspective view of a multifunction peripheral 10 according to one embodiment of the present disclosure, in which a cover 87 of the multifunction peripheral 10 is at a closed position.

A multifunction peripheral 10 as an example of a liquid consumption apparatus according to one embodiment will be described with reference to the accompanying drawings, wherein like parts and components are designated by the same reference numerals to avoid duplicating description.

In the following description, up, down, front, rear, left, and right directions related to the multifunction peripheral 10 will be referred to assuming that the multifunction peripheral 10 is disposed on a horizontal plane so as to be operable, as shown in FIG. 1A. Note that this posture of the multifunction peripheral 10 illustrated in FIG. 1A will also be referred to as an "operable posture". Specifically, an up-down direction 7 of the multifunction peripheral 10 will be defined based on the operable posture of the multifunction peripheral 10. A front-rear direction 8 will be defined assuming that a surface of the multifunction peripheral 10 formed with an opening 13 is a front surface 14A of the multifunction peripheral 10 in the operable posture. A left-right direction 9 will be defined based on an assumption that the multifunction peripheral 10 in the operable posture is viewed from its front side. In the present embodiment, in the operable posture of the multifunction peripheral 10, the up-down direction 7 is parallel to a vertical direction, and the front-rear direction 8 and the left-right direction 9 are parallel to a horizontal direction. Further, the front-rear direction 8 is perpendicular to the left-right direction 9.

<Overall Structure of Multifunction Peripheral 10>

Figure 1B:
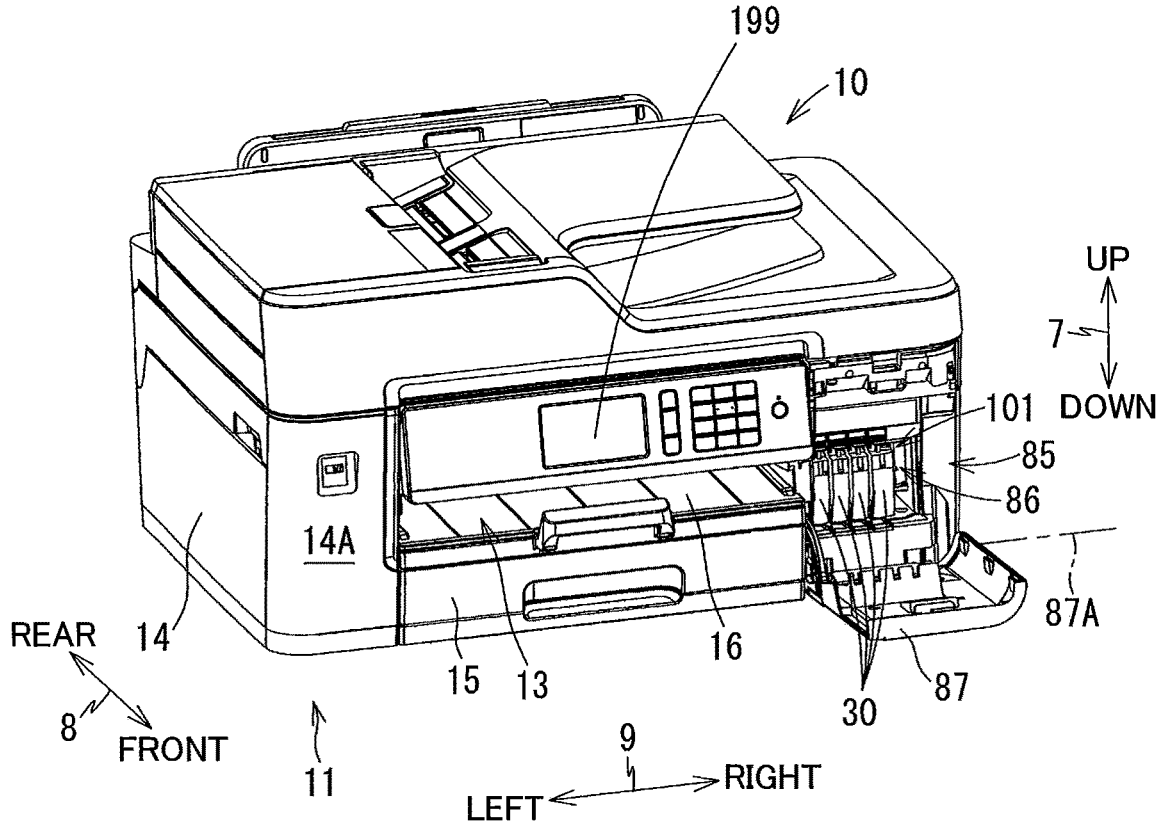
FIG. 1B is a perspective view of the multifunction peripheral 10 according to the embodiment, in which the cover 87 is at an open position.

As illustrated in FIGS. 1A and 1B, the multifunction peripheral 10 has a substantially rectangular parallelepiped shape. The multifunction peripheral 10 has a lower portion at which a printer portion 11 is provided. The printer portion 11 is configured to record an image on a sheet of paper 12 (see FIG. 2) based on an inkjet recording method. The printer portion 11 includes a casing 14 whose front surface 14A is formed with the opening 13.

Figure 2:
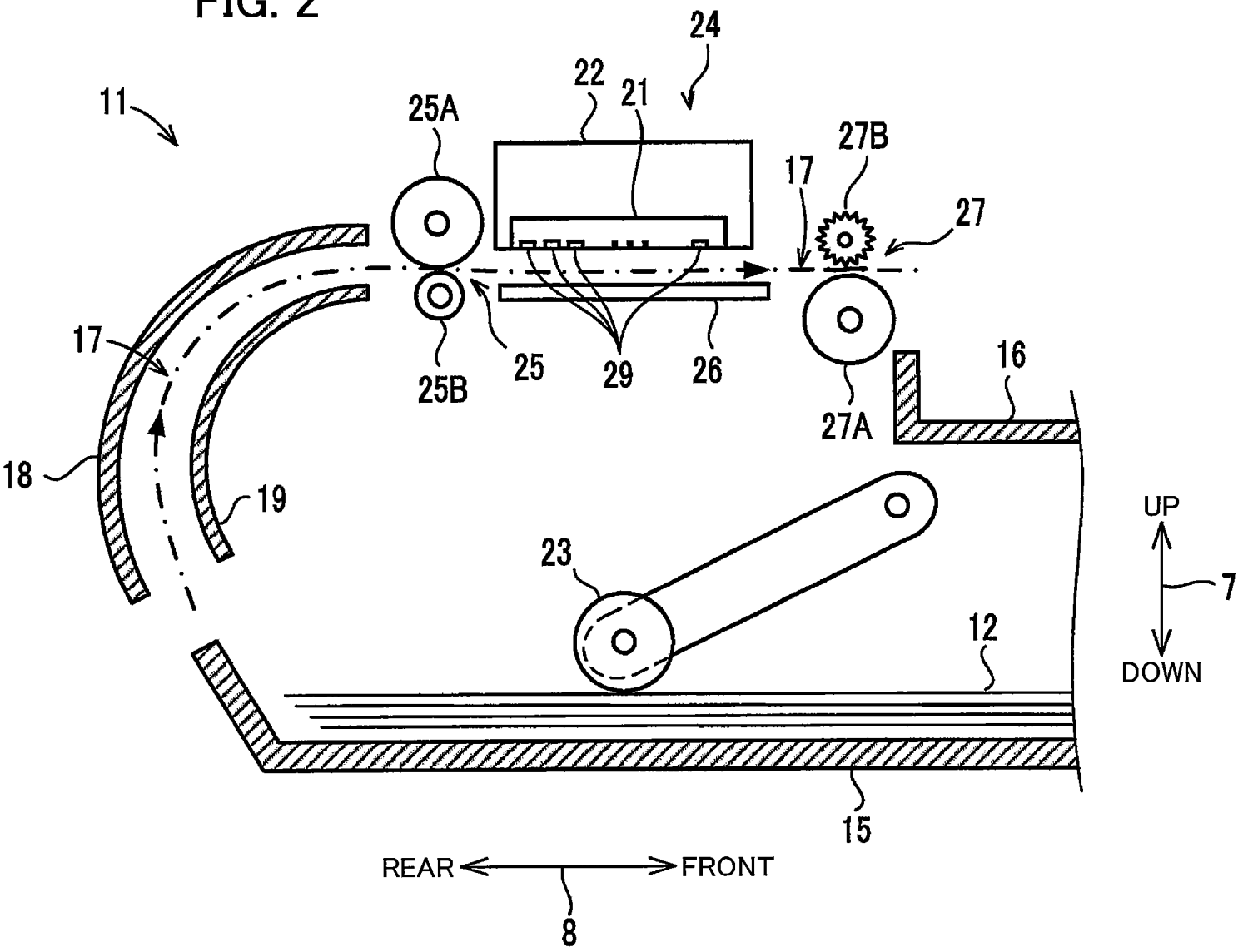
FIG. 2 is a vertical cross-sectional view schematically illustrating an internal structure of a printer portion 11 in the multifunction peripheral 10 according to the embodiment.

As illustrated in FIG. 2, within the casing 14, provided are a feed roller 23, a feed tray 15, a discharge tray 16, a conveying roller pair 25, a recording portion 24, a discharge roller pair 27, a platen 26, and a case 101 (see FIG. 1B). The multifunction peripheral 10 has various functions such as a facsimile function and a printing function. The state illustrated in FIGS. 1A and 1B is the operable posture of the multifunction peripheral 10.

<Feed Tray 15, Discharge Tray 16, Feed Roller 23>

As illustrated in FIGS. 1A and 1B, the feed tray 15 is configured to be inserted into and removed from the casing 14 through an opening 13 along the front-rear direction 8 by a user. The opening 13 is positioned at a center portion of the front surface 14A of the casing 14 in the left-right direction 9. As illustrated in FIG. 2, the feed tray 15 is configured to support a plurality of sheets 12 in a stacked state.

The discharge tray 16 is positioned above the feed tray 15. The discharge tray 16 is configured to support the sheets 12 discharged by the discharge roller pair 27.

The feed roller 23 is configured to feed each of the sheets 12 supported on the feed tray 15 toward a conveying path 17. The feed roller 23 is configured to be driven by a feed motor (not illustrated).

<Conveying Path 17>

As illustrated in FIG. 2, the conveying path 17 is a space partially defined by an outer guide member 18 and an inner guide member 19 facing each other at a predetermined interval inside the printer portion 11. The conveying path 17 extends rearward from a rear end portion of the feed tray 15, and then, U-turns frontward while extending upward at a rear portion of the printer portion 11, and passes through a space between the recording portion 24 and the platen 26, and reaches the discharge tray 16. A part of the conveying path 17 positioned between the conveying roller pair 25 and the discharge roller pair 27 is provided at a substantially center portion of the multifunction peripheral 10 in the left-right direction 9, and extends in the front-rear direction 8. A conveying direction of the sheet 12 in the conveying path 17 is indicated by a dashed-dotted arrow in FIG. 2.

<Conveying Roller Pair 25>

As illustrated in FIG. 2, the conveying roller pair 25 is disposed at the conveying path 17. The conveying roller pair 25 includes a conveying roller 25A and a pinch roller 25B opposed to each other. The conveying roller 25A is configured to be driven by a conveying motor (not illustrated). The pinch roller 25B is configured to be rotated in accordance with rotation of the conveying roller 25A. When the conveying roller 25A is rotated forward in response to forward rotation of the conveying motor, the sheet 12 is conveyed in the conveying direction (i.e. frontward direction) while nipped between the conveying roller 25A and the pinch roller 25B.

<Discharge Roller Pair 27>

As illustrated in FIG. 2, the discharge roller pair 27 is disposed at the conveying path 17 at a position downstream relative to the conveying roller pair 25 in the conveying direction. The discharge roller pair 27 includes a discharge roller 27A and a spur roller 27B opposed to each other. The discharge roller 27A is configured to be driven by the conveying motor (not illustrated). The spur roller 27B is configured to be rotated in accordance with rotation of the discharge roller 27A. When the discharge roller 27A is rotated forward in response to the forward rotation of the conveying motor, the sheet 12 is conveyed in the conveying direction (i.e. frontward direction) while nipped between the discharge roller 27A and the spur roller 27B.

<Recording Portion 24>

As illustrated in FIG. 2, the recording portion 24 is disposed at the conveying path 17 at a position between the conveying roller pair 25 and the discharge roller pair 27. The recording portion 24 is arranged so as to be opposed to the platen 26 in the up-down direction 7, with the conveying path 17 interposed between the recording portion 24 and the platen 26. The recording portion 24 is positioned above the conveying path 17, and the platen 26 is positioned below the conveying path 17. The recording portion 24 includes a carriage 22 and a recording head 21.

Figure 3:
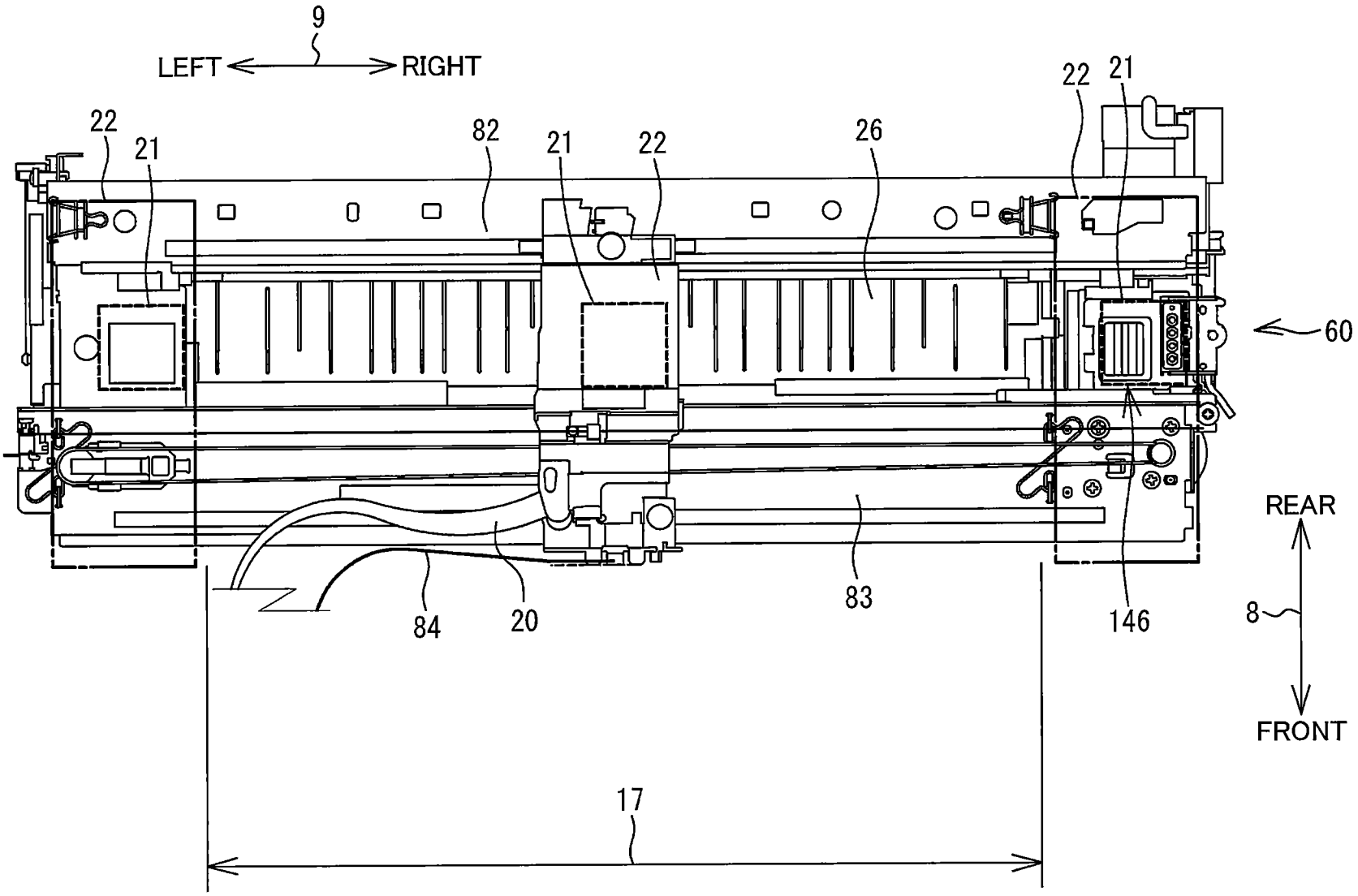
FIG. 3 is a plan view illustrating arrangement of a carriage 22 and a platen 26 of the multifunction peripheral 10 according to the embodiment.

As illustrated in FIG. 3, the carriage 22 is supported by guide rails 82 and 83. The guide rails 82 and 83 extend in the left-right direction 9 and spaced apart from each other in the front-rear direction 8. The guide rails 82 and 83 are supported by a frame (not illustrated) of the printer portion 11. The carriage 22 is connected to a known belt mechanism provided at the guide rail 83. The belt mechanism is configured to be driven by a carriage driving motor (not illustrated). The carriage 22 connected to the belt mechanism is configured to reciprocatingly move in the left-right direction 9 in response to driving of the carriage driving motor. The carriage 22 is configured to move further leftward and rightward from the conveying path 17, as indicated by the long and short dashed lines in FIG. 3.

Further, as illustrated in FIG. 3, a bundle of ink tubes 20 and a flexible flat cable 84 extend from the carriage 22.

The ink tubes 20 connect a tank 103 (see FIG. 5) to the recording head 21. Each of the ink tubes 20 is configured to supply ink (as an example of "liquid") stored in a corresponding ink cartridge 30 (as an example of "cartridge", see FIG. 4) attached to the case 101 to the recording head 21 through the tank 103. In the present embodiment, four ink cartridges 30 are attachable to the case 101. Accordingly, four ink tubes 20 are provided in one-to-one correspondence with the four ink cartridges 30 so that ink of four colors (black, magenta, cyan, and yellow) stored in the respective four ink cartridges 30 can flow through the corresponding ink tubes 20. These ink tubes 20 are bundled and connected to the carriage 22.

The flexible flat cable 84 is configured to electrically connect a controller (not illustrated) to the recording head 21. The controller is configured to control operation of the multi-function peripheral 10. The controller includes a CPU, a RAM, a ROM, and the like those surface-mounted on a circuit board (not illustrated) positioned inside the casing 14. The flexible flat cable 84 is configured to transmit control signals outputted from the controller to the recording head 21.

As illustrated in FIG. 2, the recording head 21 (as an example of "a consumption portion and a head") is mounted on the carriage 22. A plurality of nozzles 29 are provided on a lower surface (i.e. a surface facing the platen 26) of the recording head 21. The recording head 21 is supplied with ink from each ink cartridge 30 (see FIG. 4). The recording head 21 is configured to eject ink through each nozzle 29 as minute ink droplets. The ink droplets are ejected through the nozzle 29 toward the platen 26 while the carriage 22 reciprocatingly moves in the left-right direction 9. Hence, the ink droplets are landed onto the sheet 12 conveyed by the conveying roller pair 25 and supported on the platen 26, whereby an image is recorded on the sheet 12.

<Platen 26>

As illustrated in FIG. 2, the platen 26 is disposed at the conveying path 17 at a position between the conveying roller pair 25 and the discharge roller pair 27. The platen 26 is arranged so as to be opposed to the recording portion 24 in the up-down direction 7, with the conveying path 17 interposed between the platen 26 and the recording portion 24. The platen 26 supports the sheet 12 conveyed by the conveying roller pair 25 from below.

<Cover 87>

As illustrated in FIG. 1B, an opening 85 is formed in the front surface 14A of the casing 14 at a right end portion thereof. An accommodation space 86 capable of accommodating the case 101 and the tank 103 therein is formed rearward of the opening 85. A cover 87 is attached to the casing 14 so as to cover the opening 85. The cover 87 is configured to be pivotally movable about a pivot axis 87A (pivot center) extending in the left-right direction 9 between a closed position (a position illustrated in FIG. 1A) for closing the opening 85 and an open position (a position illustrated in FIG. 1B) for exposing the opening 85.

<Case 101>

Figure 4:
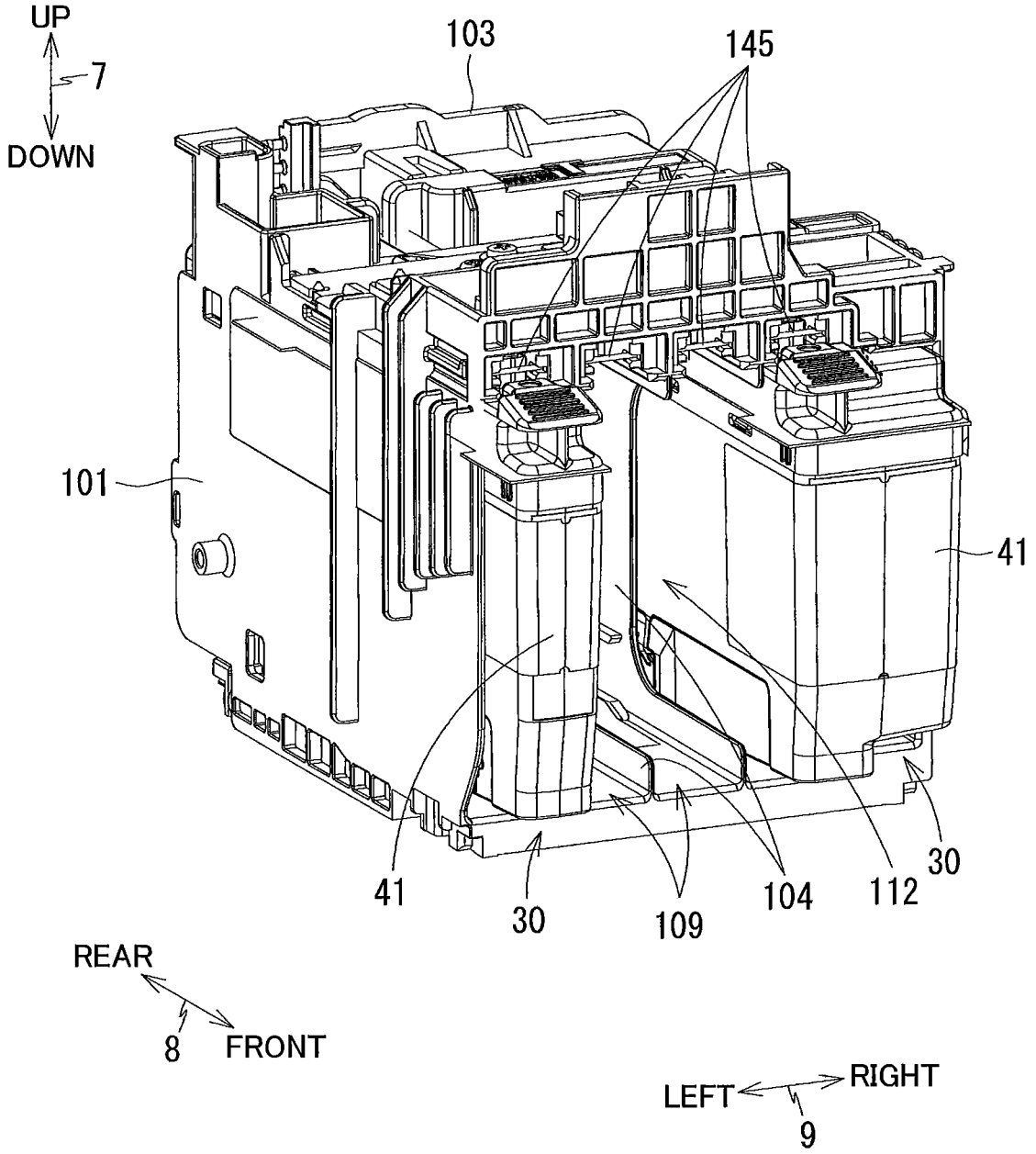
FIG. 4 is a perspective view of a case 101 and a tank 103 of the multifunction peripheral 10 according to the embodiment, as viewed from front side thereof.
Figure 5:
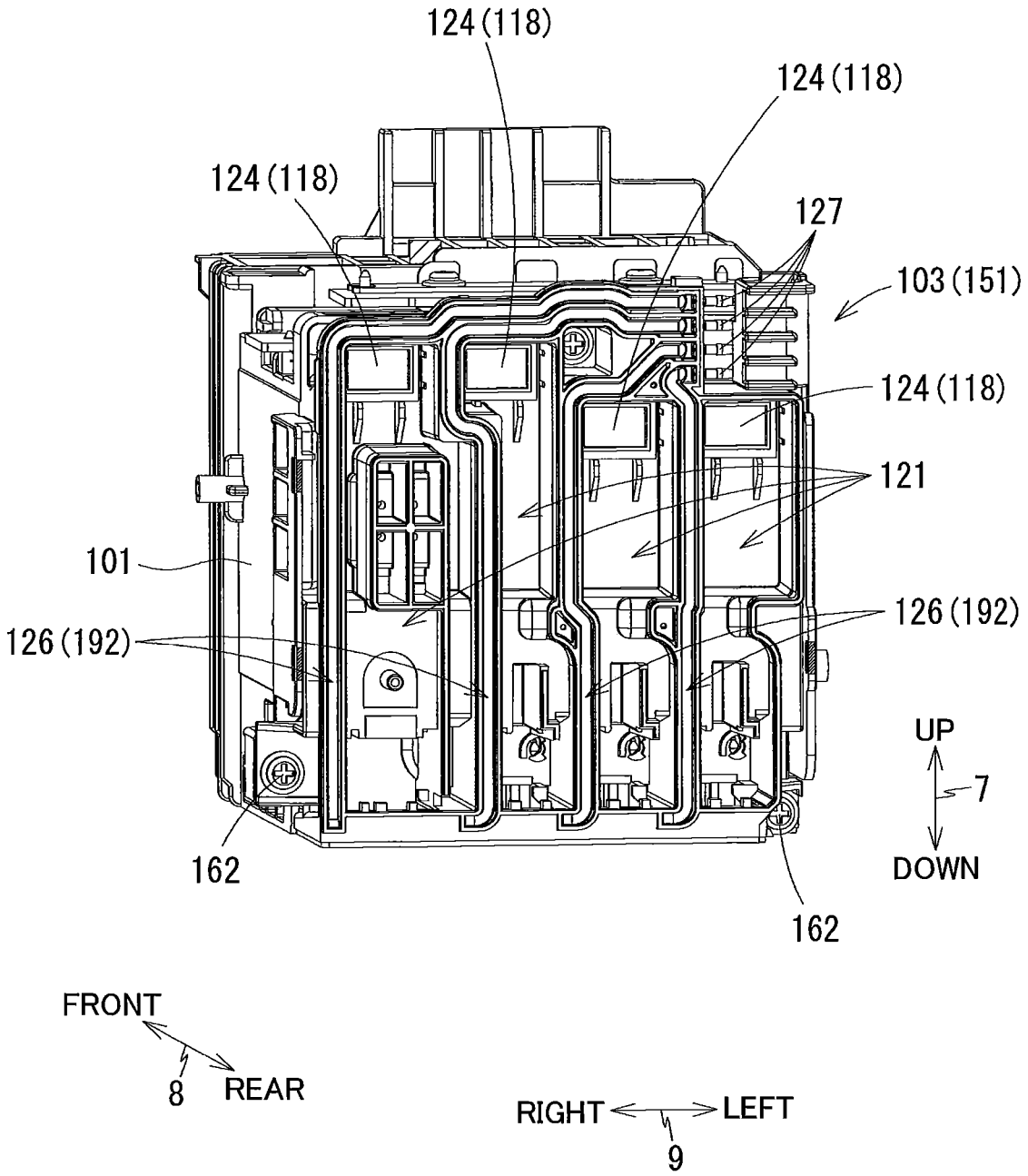
FIG. 5 is a perspective view of the case 101 and the tank 103 according to the embodiment, as viewed from rear side thereof.

As illustrated in FIGS. 4 and 5, the case 101 has a box-like shape defining an internal space therein. The case 101 has an inner top surface defining a top end of the internal space, an inner bottom surface defining a bottom end of the internal space, an inner rear surface connecting the top end and the bottom end, and an opening 112 formed at a position opposing the inner rear surface in the front-rear direction 8. The opening 112 can be exposed to the front surface 14A (see FIGS. 1A and 1B) of the casing 14 that is a surface that the user faces when the multifunction peripheral 10 is used.

The ink cartridges 30 can be inserted into and removed from the case 101 through the opening 85 (see FIG. 1B) of the casing 14 and the opening 112 of the case 101. As illustrated in FIG. 4, a bottom surface of the case 101 is formed with four guide grooves 109. Movements of the ink cartridges 30 in the front-rear direction 8 are guided by the guide grooves 109 as lower end portions of the ink cartridges 30 are inserted into the guide grooves 109.

As illustrated in FIG. 4, the case 101 has three plates 104 that partition the internal space of the case 101 into four individual spaces each elongated in the up-down direction 7. Each of the four spaces partitioned by the plates 104 is configured to receive one of the four ink cartridges 30. In the present embodiment, of the four spaces, the rightmost space is larger in dimension in the left-right direction 9 than the other three spaces. The ink cartridge 30 storing black ink is accommodated in the rightmost space, and the ink cartridges 30 respectively storing magenta ink, cyan ink, and yellow ink are accommodated in the remaining three spaces, respectively. Incidentally, the sizes of the respective spaces, the sizes of the respective ink cartridges 30 accommodated in the respective spaces, and the colors of ink stored in the respective ink cartridges 30 accommodated in the respective spaces are not limited to those described above.

<Lock Shaft 145>

As illustrated in FIG. 4, a lock shaft 145 extends in the left-right direction 9 at a position in the vicinity of the inner top surface of the case 101 and in the vicinity of the opening 112 of the case 101. The lock shaft 145 is a bar-like member extending in the left-right direction 9. The lock shaft 145 is, for example, a metal column. The lock shaft 145 has a left end fixed to a left end wall of the case 101, and a right end fixed to a right end wall of the case 101. The lock shaft 145 extends in the left-right direction 9 over the four spaces of the case 101 in which the four ink cartridges 30 can be respectively accommodated.

The lock shaft 145 is configured to retain each of the ink cartridges 30 attached to the case 101 at an attached position.

Figure 9:
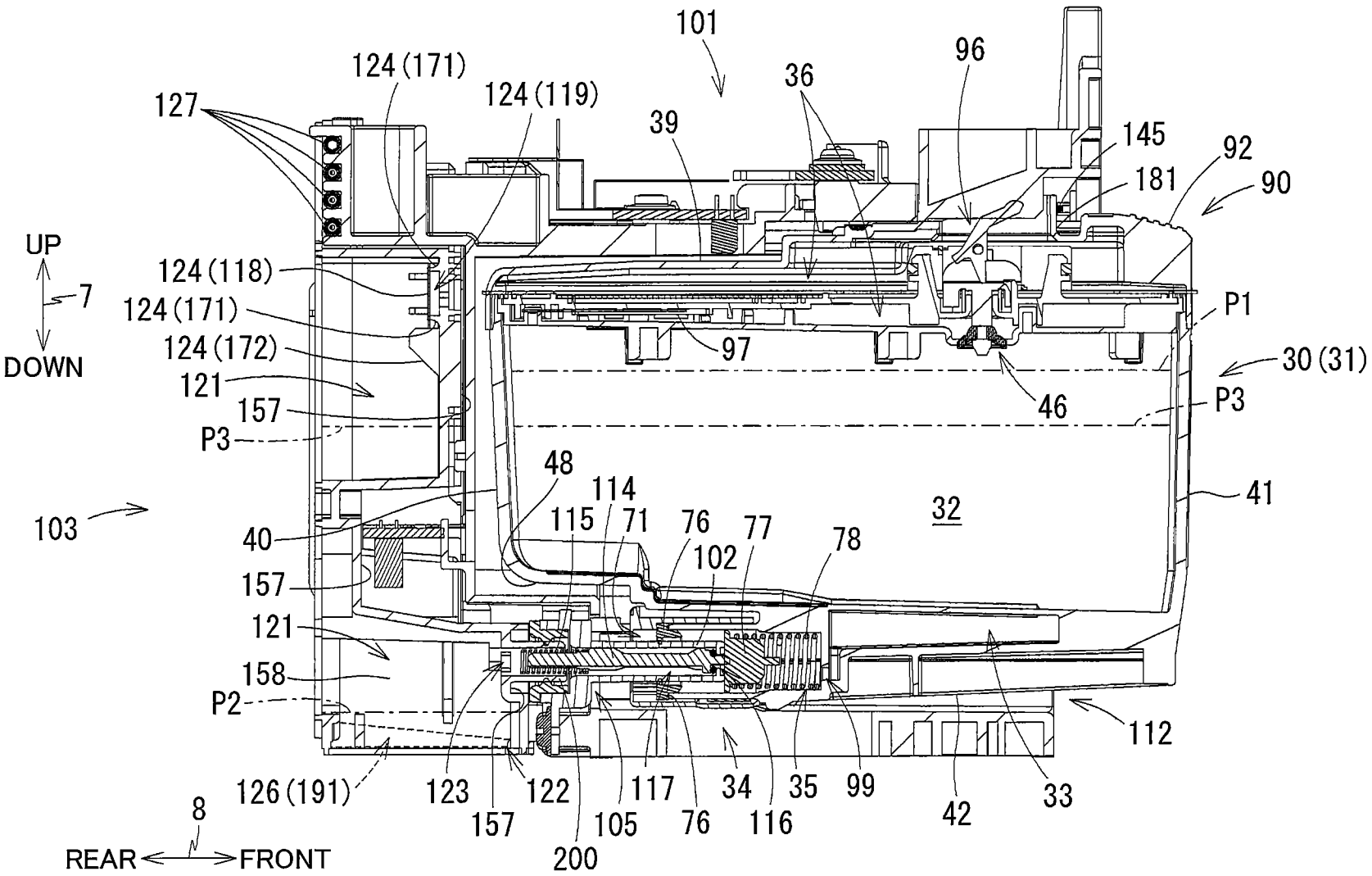
FIG. 9 is a vertical cross-sectional view illustrating a state where the ink cartridge 30 is attached to the case 101, and is connected to the tank 103 according to the embodiment.

As illustrated in FIG. 9, in a state where the ink cartridges 30 are attached to the case 101, the ink cartridges 30 are respectively engaged with the lock shaft 145. As a result, the lock shaft 145 retains each ink cartridge 30 in the case 101 against an urging force of a coil spring 78 of the ink cartridge 30 that pushes the ink cartridge 30 frontward.

<Tank 103>

Figure 7:
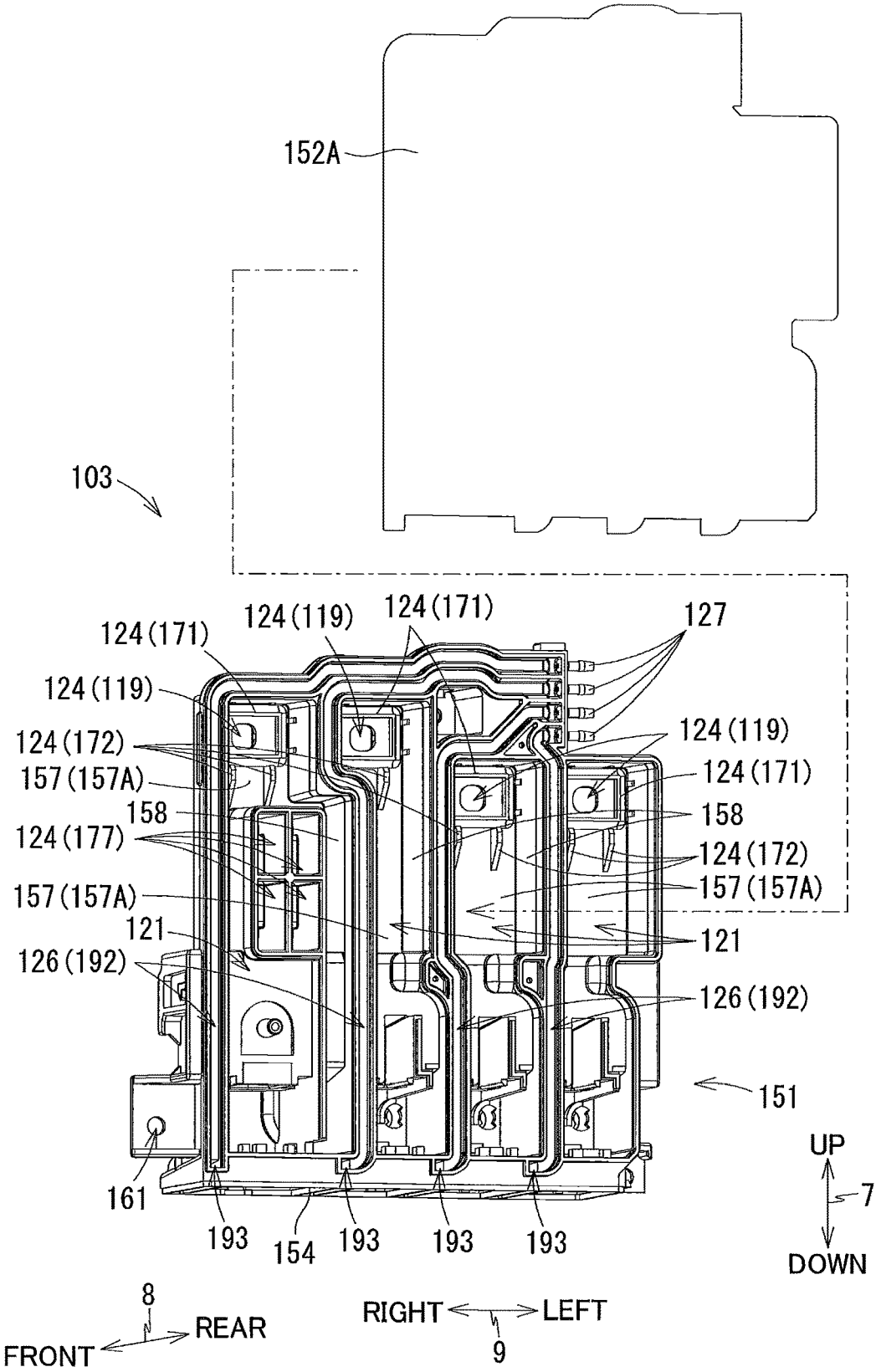
FIG. 7 is a perspective view of the tank 103 according to the embodiment as viewed from rear side thereof.
Figure 8:
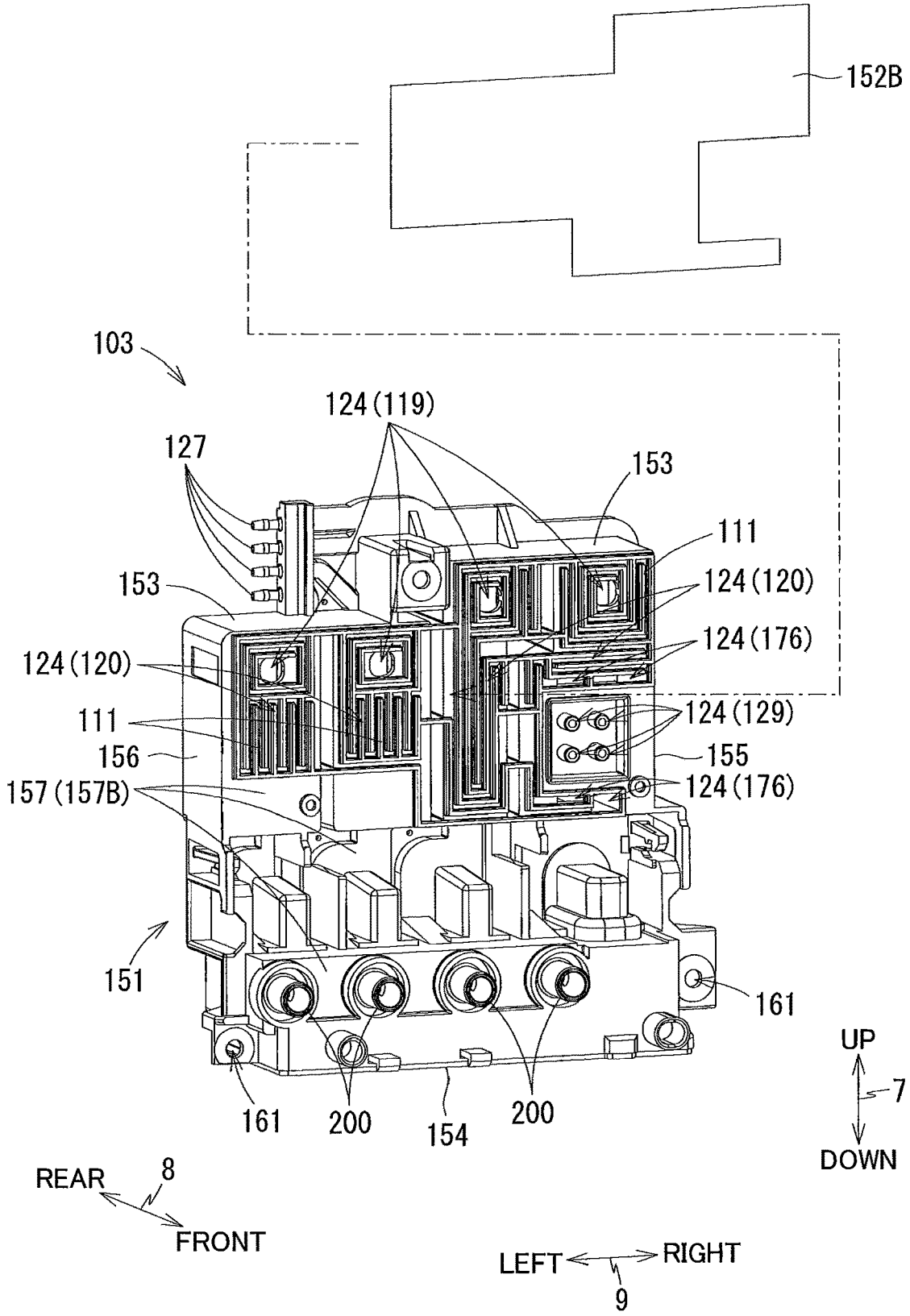
FIG. 8 is a perspective view of the tank 103 according to the embodiment as viewed from front side thereof.

As illustrated in FIGS. 7 and 8, the tank 103 has a tank body 151, a film 152A, and a film 152B. The tank body 151 has a box-like shape. Within the tank body 151, four storage chambers 121 (as an example of "a second storage chamber") each for storing ink therein are provided. The film 152A is welded to a rear surface of the tank body 151. The film 152B is welded to a front surface of the tank body 151.

The tank body 151 has two openings 161, one at a lower right end portion of the tank body 151 and the other at a lower left end portion of the tank body 151. The case 101 has two threaded-holes (not illustrated), one at a lower right end portion of a rear surface of the case 101 and the other at a lower left end portion of the rear surface of the case 101. As illustrated in FIG. 5, screws 162 are screwed into each threaded-hole of the case 101 from its rear side through the opening 161. As a result, the tank 103 is fixed to the case 101. The tank 103 fixed to the case 101 is positioned rearward relative to the case 101 and the ink cartridge 30 attached to the case 101.

As illustrated in FIGS. 7 and 8, the tank body 151 has an upper wall 153, a lower wall 154, a right wall 155, a left wall 156, a front wall 157 (as an example of "a wall"), and three inner walls 158. The upper wall 153 extends in the front-rear direction 8 and the left-right direction 9 and defines top ends of the storage chambers 121. The lower wall 154 extends in the front-rear direction 8 and the left-right direction 9 and defines bottom ends of the storage chambers 121. The right wall 155 extends in the up-down direction 7 and the front-rear direction 8 and defines a right end of the rightmost storage chamber 121. The left wall 156 extends in the up-down direction 7 and the front-rear direction 8 and defines a left end of the leftmost storage chamber 121. The front wall 157 extends in the up-down direction 7 and the left-right direction 9 and defines front ends of the storage chambers 121. The tank body 151 defines all the ends of the storage chambers 121 other than rear ends of the storage chambers 121.

As illustrated in FIG. 7, the three inner walls 158 partition an internal space of the tank body 151 into four spaces to provide the four storage chambers 121. The four storage chambers 121 are provided in one-to-one correspondence with the four spaces of the case 101.

The film 152A illustrated in FIG. 7 is welded to the rear surface of the tank body 151. In other words, the film 152A is opposed to the front wall 157 in the front-rear direction 8. The film 152A welded to the rear surface of the tank body 151 extends in the up-down direction 7 and the left-right direction 9 and defines rear ends of the storage chambers 121.

The film 152B illustrated in FIG. 7 is welded to protruding endfaces of ribs 111 formed on the front wall 157.

Next, an ink channel 126, the ink needle 102, and an air communication portion 124 provided for each of the four storage chambers 121 will be described. Since one ink channel 126, one ink needle 102, and one air communication portion 124, are provided for each of the four storage chambers 121, in the present embodiment, four ink channels 126, four ink needles 102, and four air communication portions 124 are provided at the tank 103. The four ink channels 126 have approximately the same configuration as one another. The four ink needles 102 have substantially the same configuration as one another. The four air communication portions 124 have approximately the same configuration as one another. Accordingly, one of the four ink channels 126, one of the four ink needles 102, and one of the air communication portions 124, those corresponding to the leftmost storage chamber 121 will be described in detail while description of the remaining three of these components will be omitted.

As illustrated in FIGS. 7 and 9, the tank body 151 has the four ink channels 126. As described above, the four ink channels 126 are provided in one-to-one correspondence with the four storage chambers 121. The ink channel 126 includes a first channel 191 (FIG. 9) and a second channel 192 (FIG. 7).

As illustrated in FIG. 9, the first channel 191 has one end in communication with the storage chamber 121 through an outlet 122 formed at a lower end portion and front end portion of the storage chamber 121. The first channel 191 has another end in communication with the second channel 192 through a communication port 193 (FIG. 7) positioned at a lower end portion and rear end portion of the storage chamber 121. Hence, the first channel 191 extends in generally front-rear direction 8 from the outlet 122 to the communication port 193 as indicated by a broken line in FIG. 9.

As illustrated in FIG. 7, the second channel 192 is defined by four grooves formed in the rear end portion of the tank body 151 and the film 152A fuse-bonded to the rear surface of the tank body 151. The second channel 192 has one end in communication with the communication port 193.

The second channel 192 extends upward from the communication port 193, and is bent leftward at an upper end portion of the tank body 151. The second channel 193 has another end connected to an ink outlet port 127 at a left end portion of the tank body 151. The ink outlet port 127 is connected to an ink tube 20. Hence, ink stored in the storage chamber 121 is allowed to flow out from the outlet 122 to be supplied to the recording head 21 through the corresponding ink channel 126 and the corresponding ink tube 20.

As illustrated in FIG. 8, four projecting portions 200 protrude frontward from a lower portion of the front wall 157 of the tank body 151. As illustrated in FIG. 9, one ink needle 102 having hollow configuration is attached to each of the four projecting portions 200. That is, four ink needles 102 are provided. The four ink needles 102 are provided in one-to-one correspondence with the four storage chambers 121. The ink needle 102 has an internal space 117 in communication with the corresponding storage chamber 121 through an inlet 123 (see FIG. 9) formed in the front wall 157 of the tank body 151. The inlet 123 is positioned upward relative to the outlet 122.

As illustrated in FIG. 9, the ink needle 102 protrudes frontward from the front wall 157. A through-hole 105 is formed in a rear wall of the case 101. The ink needle 102 penetrates the through-hole 105 and protrudes into the internal space of the case 101.

In the internal space 117 of the ink needle 102, a valve 114 and a coil spring 115 are accommodated. The valve 114 is movable in the front-rear direction 8 to open and close an opening 116 formed in a protruding tip end of the ink needle 102. The coil spring 115 is configured to urge the valve 114 frontward. Thus, in a state where no external force is applied to the valve 114 (that is, in a state where the ink cartridge 30 is not attached to the case 101), the valve 114 closes the opening 116. Further, in a state where no external force is applied, a front end portion of the valve 114 urged by the coil spring 115 protrudes frontward from the opening 116.

As illustrated in FIGS. 7 and 8, the tank body 151 has the four air communication portions 124 (as an example of "a second air communicating portion"). As described above, the four air communication portions 124 are provided in one-to-one correspondence with the four storage chambers 121. Each air communication portion 124 is configured to allow the corresponding storage chamber 121 to communicate with the atmosphere.

The air communication portion 124 includes a communication port 119, a first rib 171, a semipermeable membrane 118 (see FIGS. 5 and 9), second ribs 172, a labyrinth channel 120, and an air opening port 129.

The communication port 119 is formed in a portion of the front wall 157. The communication port 119 penetrates the front wall 157 in the front-rear direction 8. The communication port 119 is positioned at an upper portion of the storage chamber 121.

As illustrated in FIG. 7, the first rib 171 protrudes rearward from a rear surface 157A (as an example of "a first surface") of the front wall 157. The rear surface 157A is a surface of the front wall 157 that faces rearward. That is, the rear surface 157A is a surface of the front wall 157 that faces the storage chamber 121. When viewing the tank 103 from the rear, the first rib 171 is formed so as to surround the communication port 119.

The semipermeable membrane 118 blocks liquid from flowing therethrough and allows air to pass therethrough. As illustrated in FIGS. 5 and 9, the semipermeable membrane 118 is welded to a rear surface (protruding end face) of the first rib 171 so as to cover the communication port 119. The semipermeable membrane 118 is positioned at the rear surface 157A side of the front wall 157.

As illustrated in FIG. 7, the second ribs 172 protrude rearward from the rear surface 157A of the front wall 157. The second ribs 172 are positioned below the first rib 171. The second ribs 172 include two ribs provided for each first rib 171. Specifically, one of the two second ribs 172 is positioned below the left portion of the first rib 171, and remaining one of the second ribs 171 is positioned below the right portion of the first rib 171. The second ribs 172 extend in the up-down direction 7. The semipermeable membrane 118 is welded to the first rib 171 such that the lower end of the semipermeable membrane 118 abuts against the upper ends of the second ribs 172. That is, the semipermeable membrane 118 is subjected to positioning in the up-down direction 7 by the second ribs 172. The position and the number of the second ribs 172 are not limited to those described above.

As illustrated in FIG. 8, the labyrinth channel 120 is defined by a front surface 157B (as an example of "a second surface") of the front wall 157, a rib 111 protrudes from the front surface 157B, and a film 152B welded to a protruding end surface of the rib 111. The front surface 157B is opposite to the rear surface 157A and also a surface of the front wall 157 that faces frontward. That is, the front surface 157B is a surface of the front wall 157 that faces the side opposite to the storage chamber 121. The labyrinth channel 120 is formed on a part of the front surface 157B, the part being opposite to a part of the rear surface 157A where at least the semipermeable membrane 118, the first rib 171, and the second ribs 172 are formed.

The labyrinth channel 120 has a labyrinth shape and extends in a bending fashion along its length from its one end to another end. The one end of the labyrinth channel 120 is in communication with the communication port 119. The other end of the labyrinth channel 120 is in communication with the air opening port 129. Specifically, the labyrinth channel 120 extends to a buffer space 177 (see FIG. 7) formed in the front wall 157 through a through-hole 176 formed at the right portion of the front wall 157. A through-hole is formed at a portion of the front wall 157 that defines the buffer space 177. This through-hole is the air opening port 129. The air opening port 129 communicates with the outside of the tank 103. Thus, the storage chamber 121 is open to the atmosphere through the air communication portion 124.

<Ink Cartridge 30>

Figure 6:
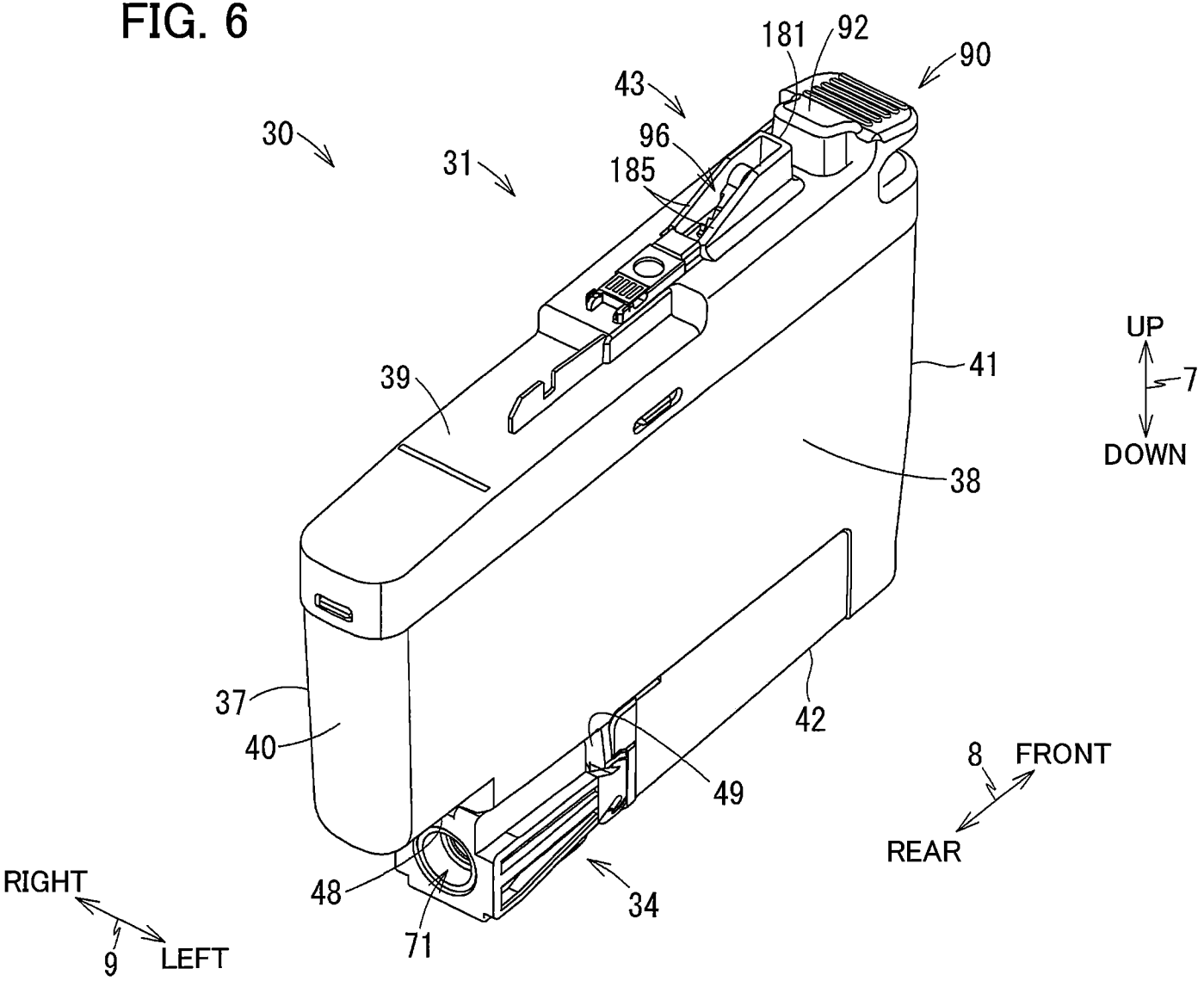
FIG. 6 is a perspective view of an ink cartridge 30 attachable to the case 101 of the multifunction peripheral 10 according to the embodiment as viewed from rear side thereof.

The ink cartridge 30 illustrated in FIGS. 6 and 9 is a container for storing ink therein. The posture of the ink cartridge 30 illustrated in FIGS. 6 and 9 is the operable posture of the ink cartridge 30.

As illustrated in FIG. 6, the ink cartridge 30 has a cartridge casing 31 that is substantially rectangular parallelepiped shaped. The cartridge casing 31 has a rear wall 40, a front wall 41, an upper wall 39, and a lower wall 42, a right wall 37, and a left wall 38.

The cartridge casing 31 has a generally flattened shape as a whole so that a dimension of the cartridge casing 31 in the left-right direction 9 is small, and a dimension of the cartridge casing 31 in the up-down direction 7 and a dimension of the cartridge casing 31 in the front-rear direction 8 are greater than the dimension of the cartridge casing 31 in the left-right direction 9. In the cartridge casing 31, at least the front wall 41 has translucency that allows liquid levels of ink stored in a storage chamber 32 and a storage chamber 33 (see FIG. 9) to be visually recognized from an outside of the ink cartridge 30.

The cartridge casing 31 further has a sub-lower wall 48. The sub-lower wall 48 is positioned upward relative to the lower wall 42 and extends frontward continuously from a lower end of the rear wall 40. In the present embodiment, a rear end of the sub-lower wall 48 is positioned rearward relative to a rear end of an ink supply portion 34 (described later), and a front end of the sub-lower wall 48 is positioned frontward relative to a rear end of the ink supply portion 34. The lower wall 42 and the sub-lower wall 48 are connected to each other through a stepped surface 49. The ink supply portion 34 extends rearward from the stepped surface 49 at a position downward relative to the sub-lower wall 48 and upward relative to the lower wall 42.

A protruding portion 43 is provided at an outer surface of the upper wall 39. The protruding portion 43 protrudes upward from the outer surface of the upper wall 39 and extends in the front-rear direction 8. The protruding portion 43 has a lock surface 181 facing frontward. The lock surface 181 is positioned upward relative to the upper wall 39. The lock surface 181 is configured to contact the lock shaft 145 in a state where the ink cartridge 30 is attached to the case 101. As illustrated in FIG. 9, the lock surface 181 comes into contact with the lock shaft 145 while pushing the lock shaft 145 frontward, allowing the ink cartridge 30 to be retained in the case 101 against the urging force of the coil spring 78.

As illustrated in FIG. 6, the protruding portion 43 further has a sloped surface 185. The sloped surface 185 is positioned rearward relative to the lock surface 181. During an attachment process of the ink cartridge 30 to the case 101, the lock shaft 145 is guided by the sloped surface 185. As the lock shaft 145 moves along the sloped surface 185, the lock shaft 145 is guided to a position capable of contacting the lock surface 181.

An operation portion 90 is provided on the upper wall 39 at a position frontward relative to the lock surface 181. The operation portion 90 has an operation surface 92. When the operation surface 92 is pressed downward in a state where the ink cartridge 30 is attached to the case 101, the ink cartridge 30 is pivotally moved, thereby moving the lock surface 181 downward. As a result, the lock surface 181 is positioned further downward than the lock shaft 145. This allows the ink cartridge 30 to be removed from the case 101.

As illustrated in FIG. 9, the storage chamber 32, the storage chamber 33, an ink valve chamber 35, and an air channel 36 are provided within the cartridge casing 31. The storage chamber 32, the storage chamber 33, and the ink valve chamber 35 are configured to store ink therein. The storage chamber 32, the storage chamber 33, and the ink valve chamber 35 are examples of "first storage chamber". The air channel 36 allows the storage chamber 32, the storage chamber 33 and the ink valve chamber 35 to communicate with atmosphere. The air channel 36 is an example of "first air communicating portion". The storage chamber 32 and the storage chamber 33 are in communication with each other through a through-hole (not illustrated). The storage chamber 32 and the air channel 36 are in communication with each other through a through-hole 46. The storage chamber 33 and the ink valve chamber 35 are in communication with each other through a through-hole 99. The through-hole 99 is formed at a lower end of the storage chamber 33. The air channel 36 is positioned above the storage chamber 32.

The air channel 36 is in communication with an outside of the ink cartridge 30 through an air communication port 96. The air communication port 96 is formed in the protruding portion 43. In other words, the storage chamber 32, the storage chamber 33, and the ink valve chamber 35 are in communication with the outside of the ink cartridge 30 through the air channel 36. A portion of the air channel 36 between the through-hole 46 and the air communication port 96 is sealed by a semipermeable membrane 97. The semipermeable membrane 97 blocks liquid from flowing therethrough and allows air to pass therethrough.

As illustrated in FIGS. 6 and 9, the ink supply portion 34 protrudes rearward from the stepped surface 49. The ink supply portion 34 has a cylindrical outer shape. The ink supply portion 34 has an inner space serving as the ink valve chamber 35. The rear end of the ink supply portion 34 is opened to the outside of the ink cartridge 30 through an ink supply port 71. This allows the ink valve chamber 35 to communicate with the outside of the ink cartridge 30. A seal member 76 is provided at a rear end portion of the ink supply portion 34. A front end of the ink valve chamber 35 is in communication with a lower end of the storage chamber 33 through the through-hole 99, as described above.

As illustrated in FIG. 9, a valve 77 and the coil spring 78 are accommodated in the ink valve chamber 35. The valve 77 is configured to move in the front-rear direction 8 to open and close the ink supply port 71 penetrating a center portion of the seal member 76. The coil spring 78 urges the valve 77 rearward. Thus, in a state where no external force is applied to the valve 77, the valve 77 closes the ink supply port 71 formed in the seal member 76.

The seal member 76 is a disk-shaped member having a center portion formed with a through-hole. The seal member 76 is made of an elastic material such as rubber or elastomer, for example. A cylindrical inner peripheral surface defining the through-hole penetrating the center portion of the seal member 76 in the front-rear direction 8 provides the ink supply port 71. The ink supply port 71 has an inner diameter slightly smaller than an outer diameter of the ink needle 102.

<Supply of Ink>

Next, ink supply from the ink cartridge 30 to the tank 103 and the recording head 21 will be described with reference to FIG. 9.

As the ink cartridge 30 is attached to the case 101 in a state where the valve 77 closes the ink supply port 71 and the valve 114 closes the opening 116 of the ink needle 102, the ink needle 102 enters into the ink supply port 71. As a result, the ink cartridge 30 is connected to the tank 103. At this time, an outer peripheral surface of the ink needle 102 provides liquid-tight contact with an inner peripheral surface of the seal member 76 defining the ink supply port 71 while elastically deforming the seal member 76. As the tip end of the ink needle 102 passes through the seal member 76 and advances into the ink valve chamber 35, the tip end of the ink needle 102 abuts on the valve 77. As the ink cartridge 30 is further inserted into the case 101, the ink needle 102 moves the valve 77 rearward against the urging force of the coil spring 78, thereby opening the ink supply port 71.

While the tip end of the ink needle 102 abuts on the valve 77, the valve 77 abuts on the valve 114 from a front side thereof and pushes the valve 114 rearward. Hence, the valve 114 moves rearward against the urging force of the coil spring 115. This opens the opening 116 of the ink needle 102. As a result, the ink stored in the storage chamber 32 and the storage chamber 33 is allowed to flow into the storage chamber 121 of the tank 103 through the ink valve chamber 35 of the ink supply portion 34, the internal space 117 of the ink needle 102, and the inlet 123.

The storage chamber 32 and the storage chamber 33 of the ink cartridge 30 are open to the atmosphere through the air channel 36. Further, the storage chamber 121 of the tank 103 is open to the atmosphere through the air communication portion 124. Thus, the ink stored in the storage chamber 32 and the storage chamber 33 of the ink cartridge 30 is supplied to the storage chamber 121 of the tank 103 through the ink valve chamber 35 of the ink supply portion 34, the internal space 117 of the ink needle 102, and the inlet 123 due to hydraulic head difference. The storage chamber 121 stores the ink flowing therein from the storage chamber 32 and the storage chamber 33. The ink stored in the storage chamber 121 flows out of the storage chambers 121 to flow into the ink tube 20 through the ink channel 126 to be supplied to the recording head 21.

The ink supply from the ink cartridge 30 to the recording head 21 due to hydraulic head difference is performed until the liquid level of the ink stored in the storage chamber 32, the storage chamber 33, and the ink valve chamber 35 of the ink cartridge 30 becomes equal in height to the liquid level of the ink stored in the storage chamber 121 of the tank 103 in the up-down direction 7.

<Position of Semipermeable Membrane 118>

When the ink cartridge 30 where a maximum amount of ink is stored in the storage chambers 32, 33 and the ink valve chamber 35 is connected to the tank 103, supply of the ink is started from the storage chambers 32, 33 and the ink valve chamber 35 to the storage chamber 121 by the water head difference. As a result, the level of surface of the ink stored in the storage chambers 32, 33 and the ink valve chamber 35 and the level of the surface of the ink stored in the storage chamber 121 become equal to each other in height. In this state, the semipermeable membrane 118 is positioned above the level of the surface of the ink stored in the storage chambers 32, 33, and the ink valve chamber 35. Incidentally, in this embodiment, the semipermeable membrane 118 is positioned below an upper end of the cartridge 30, and has a portion whose height is equal to that of the air channel 36.

As illustrated in FIG. 9, when the maximum amount of ink is stored in the storage chambers 32, 33 and the ink valve chamber 35 in the ink cartridge 30, the level of the ink stored in the storage chambers 32, 33 and the ink valve chamber 35 is indicated by a position P1, and the level of the ink does not go beyond the position P1 in a state where the ink is supplied by the water head difference. In the present embodiment, the semipermeable membrane 118 is positioned above the position P1. That is, in a state where the ink cartridge 30 where the maximum amount of ink is stored in the storage chambers 32, 33 and the ink valve chamber 35 is connected to the tank 103, the semipermeable membrane 118 is positioned above the maximum liquid surface level (the position P1).

Effects of Present Embodiment

According to the present embodiment, when the ink cartridge 30 where the maximum amount of ink is stored in the storage chambers 32, 33, and the ink valve chamber 35, e.g., a new ink cartridge 30, is connected to the tank 103, the ink stored in the storage chambers 32, 33 and the ink valve chamber 35 is supplied to the storage chamber 121 by the water head difference. This ink supply is continued until the level of the ink stored in the storage chamber 121 and the level of the ink stored in the storage chambers 32, 33 and the ink valve chamber 35 become equal to each other in height. When the ink supply is stopped (when the level of the ink stored in the storage chamber 121 and level of ink stored in the storage chambers 32, 33 and the ink valve chamber 35 become equal to each other in height), the semipermeable membrane 118 is positioned above the level of the ink stored in the storage chambers 32, 33 and the ink valve chamber 35. This can reduce a possibility of wetting the semipermeable membrane 118 with the ink due to contact with the ink.

When a new ink cartridge 30 (ink cartridge 30 storing the maximum amount of ink in the storage chambers 32, 33 and the ink valve chamber 35) is connected to the tank 103 storing therein sufficient ink in the storage chamber 121 (here, the level of the ink in the storage chamber 121 is less than P1), the level of the ink stored in the storage chamber 121 rises by the water head difference. This ink level rising occurs each time the new ink cartridge 30 is connected to the tank 103. In this case, the level of the ink stored in the storage chambers 32, 33, the ink valve chamber 35, and the storage chamber 121 is converged to the maximum ink level (position P1) in a state where the maximum amount of ink is stored in the storage chambers 32, 33 and the ink valve chamber 35 as a result of repeated replacement of the new ink cartridge without substantial consumption of the ink stored in the storage chamber 121 for subsequent printing on a basis of the user's operation. According to the present embodiment, the semipermeable membrane 118 is positioned above the maximum level of the ink (position P1) defined by the storage of the maximum amount of the ink in the storage chambers 32, 33 and the ink valve chamber 35. Hence, a possibility of wetting of the semipermeable membrane 118 due to contact with the ink can be reduced.

Further, according to the present embodiment, the front wall 157 extends in the up-down direction 7, so that the length of the tank 103 in the front-rear direction 8 can be reduced.

Further, according to the present embodiment, the semipermeable membrane 118 is positioned on the rear surface 157A side of the front wall 157 that faces the storage chamber 121. Therefore, external force may not be easily applied to the semipermeable membrane 118. Thus, a possibility of damage to the semipermeable membrane 118 can be reduced.

Further, if the second ribs 172 were not provided, the semipermeable membrane 118 may be positioned below an intended position due to mounting error of the semipermeable membrane 118. When ink adheres to the lower end of the semipermeable membrane 118, the ink may spread over the entire semipermeable membrane 118. On the other hand, according to the present embodiment, the lower end of the semipermeable membrane 118 can be defined by the second ribs 172. Thus, a possibility that the semipermeable membrane 118 is inadvertently positioned below the intended position due to the mounting error can be reduced. This can reduce a possibility of ink adhesion to the lower end of the semipermeable membrane 118.

Further, according to the present embodiment, the labyrinth channel 120 can be formed on the back side of the communication port 119. This can make an area required for forming the communication port 119 and the labyrinth channel 120 smaller than a case where the communication port 119 and the labyrinth channel 120 are formed on the same side. As a result, the position of the communication port 119 can be flexibly set, so that the communication port 119 and the semipermeable membrane 118 that covers the communication port 119 can be easily disposed at a higher position.

Further, according to the present embodiment, all of the air opening port 129, the labyrinth channel 120, and the communication port 119 are formed on the same wall (front wall 157). Thus, the tank can have a simplified and compact construction in comparison with a case where the air opening port 129, the labyrinth channel 120, and the communication port 119 are not formed on the same wall.

Modification 1

In the above embodiment, the semipermeable membrane 118 is positioned above the position P1. However, the semipermeable membrane 118 may be disposed at positions described below other than the position P1.

For example, as illustrated in FIG. 9, when an ink cartridge 30 storing the maximum amount of the ink in the storage chambers 32, 33 and the ink valve chamber 35 (the level of ink in the storage chamber 32 is at the position P1) is connected to the tank 103 where the level of ink stored in the storage chamber 121 is positioned between the inlet 123 and the outlet 122 in the up-down direction 7 (the level of ink in the storage chamber 121 is at a position P2), supply of the ink from the storage chambers 32, 33 and the ink valve chamber 35 to the storage chamber 121 is started by the water head difference. As a result, the level of the ink stored in the storage chambers 32, 33 and the ink valve chamber 35 becomes equal to the level of the ink stored in the storage chamber 121. In this state, the semipermeable membrane 118 may be positioned above the level of the ink stored in the storage chambers 32, 33 and the ink valve chamber 35.

The level of the ink stored in the storage chambers 32, 33 and the ink valve chamber 35 in the above state is at a position P3 that is lower than the position P1. The volume of a part of the storage chamber 32 ranging between the position P1 and the position P3 is equal to the volume of a part of the storage chamber 121 ranging between the position P3 and the position P2. In this connection, the semipermeable membrane 118 may be positioned above the position P3. That is, the semipermeable membrane 118 may be positioned not only above the position P1 but also at a position below the position P1 and above the position P3.

Normally, when the amount of ink stored in the storage chamber 121 of the tank 103 is reduced to cause the level of the ink to be positioned below the inlet 123, the position of the level of the ink is detected by a sensor (not illustrated). A controller of the multifunction peripheral 10 receives the detection signal from the sensor and then prompts the user to replace the ink cartridge 30 with a new one through a pictorial image on a panel 199 or voice. Further, after the detection, when the ink stored in the storage chamber 121 of the tank 103 is further consumed by a predetermined amount by execution of image recording onto the sheet 12, the controller stops the execution of image recording operation so as to prevent the air in the storage chamber 121 from entering the recording head 21 which may be caused when the level of the ink becomes lower than the outlet 122.

When the ink cartridge 30 is replaced with a new one by the user, and the new ink cartridge 30 (ink cartridge 30 storing the maximum amount of ink in the storage chambers 32, 33 and the ink valve chamber 35) is connected to the tank 103, the ink stored in the storage chambers 32, 33 and the ink valve chamber 35 is supplied to the storage chamber 121 by the water head difference. According to the present modification, the semipermeable membrane 118 is positioned above the level (position P3) of the ink stored in the storage chambers 32, 33 and the ink valve chamber 35 when the ink supply is stopped (when the level of the ink stored in the storage chambers 32, 33 and the ink valve chamber 35 becomes equal to the level of the ink stored in the storage chamber 121). This can reduce a possibility that the semipermeable membrane 118 gets wet due to contact with the ink.

Incidentally, according to the modification 1, the position P3 is above liquid levels (positions P4 and P5 in modifications 2 and 3 described later) at completion of the ink supply by the water head difference. That is, the position P3 in the modification 1 may be the highest position of the level of the ink stored in the storage chamber 121 in "normal use". Specifically, the position P3 may be an arbitrary position between a highest position and a lowest position. The highest position of P3 is the level of the ink stored in the storage chamber 121 after completion of the ink supply by the water head difference on an assumption that the new ink cartridge 30 is connected to the tank 103 where the level of the ink stored in the storage chamber 121 is positioned at the (substantially) same position as the inlet 123 in the up-down direction 7. The lowest position of P3 is the level of the ink stored in the storage chamber 121 after completion of the ink supply by the water head difference on an assumption that the new ink cartridge 30 is connected to the tank 103 where the level of the ink stored in the storage chamber is positioned at the same position as the outlet 122 in the up-down direction 7. Thus, by disposing the semipermeable membrane 118 above the position P3, a possibility that the semipermeable membrane 118 gets wet due to contact with the ink can be reduced. Further, by disposing the semipermeable membrane 118 above the highest position of the position P3, a possibility that the semipermeable membrane 118 gets wet due to contact with the ink can be reduced more suitably.

The "normal use" referred herein is a situation where a new ink cartridge 30 is connected to the tank 103 of the multifunction peripheral 10 immediately after shipping, and then, the ink to be supplied from the ink cartridge 30 to the tank 103 is consumed, and an alarm is notified to prompt the user to replace the ink cartridge 30 with a new cartridge. Thus, the "normal use" does not encompass a situation where the old ink cartridge 30 is replaced with a new one although the ink of the old cartridge 30 has scarcely been consumed.

Modification 2

Figure 10:
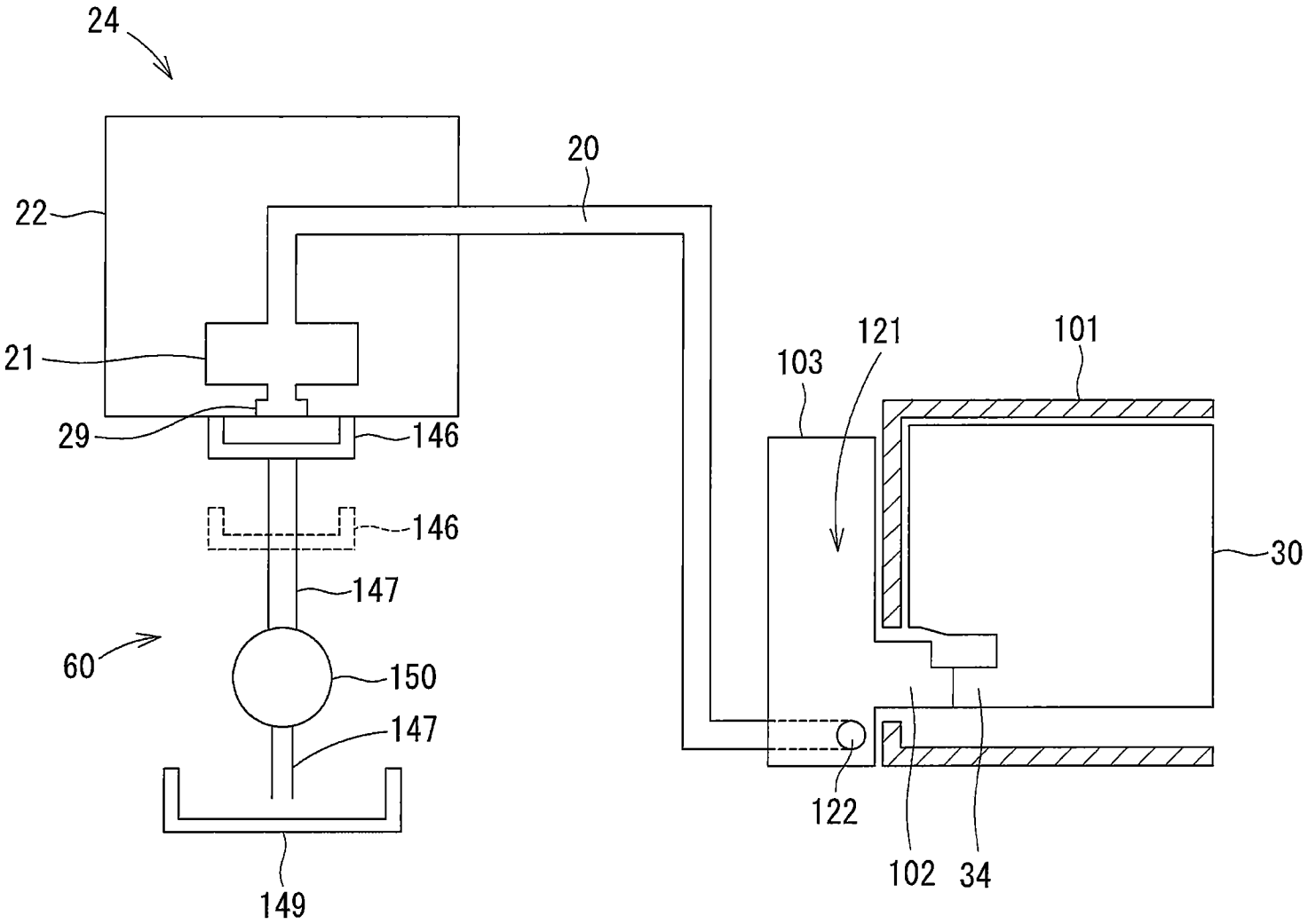
FIG. 10 is a schematic vertical cross-sectional view illustrating the ink cartridge 30, the tank 103, a recording portion 24, and a purge mechanism 60.

The multifunction peripheral 10 may be provided with a purge mechanism 60 as illustrated in FIG. 10. The purge mechanism 60 is adapted for sucking ink from the recording head 21. The purge mechanism 60 per se is conventional. For example, as illustrated in FIG. 10, the purge mechanism 60 includes a cap 146, a pump 150, a waste liquid tank 149, and a tube 147.

The cap 146 is made from an elastic material such as rubber and elastomer. The cap 146 is at a position facing the carriage 22 (indicated by a long dashed short dashed line in FIG. 3) positioned leftward or rightward of the conveying path 17. The cap 146 is configured to be movable between a cap position (indicated by a solid line in FIG. 10) where the cap 146 is in close contact with the recording head 21 and an uncap position (indicated by a broken line in FIG. 10) below the cap position and where the cap 146 is separated from the recording head 21.

The waste liquid tank 149 stores ink sucked from the recording head 21. The tube 147 has one end connected to the cap 146, and another end positioned immediately above the waste liquid tank 149.

The pump 150 is, for example, a rotary type tube pump. The pump 150 is driven by a pump drive motor (not illustrated) to squeeze the tube 147. As a result, an ink flow directing from the cap 146 toward the waste liquid tank 149 is formed in the tube 147.

Thus, when the pump drive motor is driven in a state where the cap 146 is set at the cap position and is in contact with the recording head 21, the ink stored in the storage chambers 32, 33, the ink valve chamber 35, and the storage chamber 121 is sucked into the recording head 21 through the ink tube 20. Further, the ink sucked into the recording head 21 is sucked into the tube 147 through the cap 146 to flow out toward the waste liquid tank 149. This ink suction processing is the purge processing.

The purge processing is executed at various timelines. For example, the purge processing will be started when the ink cartridge 30 where maximum amount of ink is stored in the storage chambers 32, 33 and the ink valve chamber 35 (where the level of the ink stored in the cartridge 30 is at the position P1) is connected to the tank 103. This purge processing is initial purge processing.

In the modification 2, after execution of the initial purge processing, the semipermeable membrane 118 is positioned above the level of the ink stored in the storage chambers 32, 33 and the ink valve chamber 35 in a state where the level of the ink stored in the storage chambers 32, 33 and the ink valve chamber 35 becomes equal to the level of the ink stored in the storage chamber 121 as a result of the ink supply from the storage chambers 32, 33 and the ink valve chamber 35 to the storage chamber 121 by the water head difference.

Figure 11:
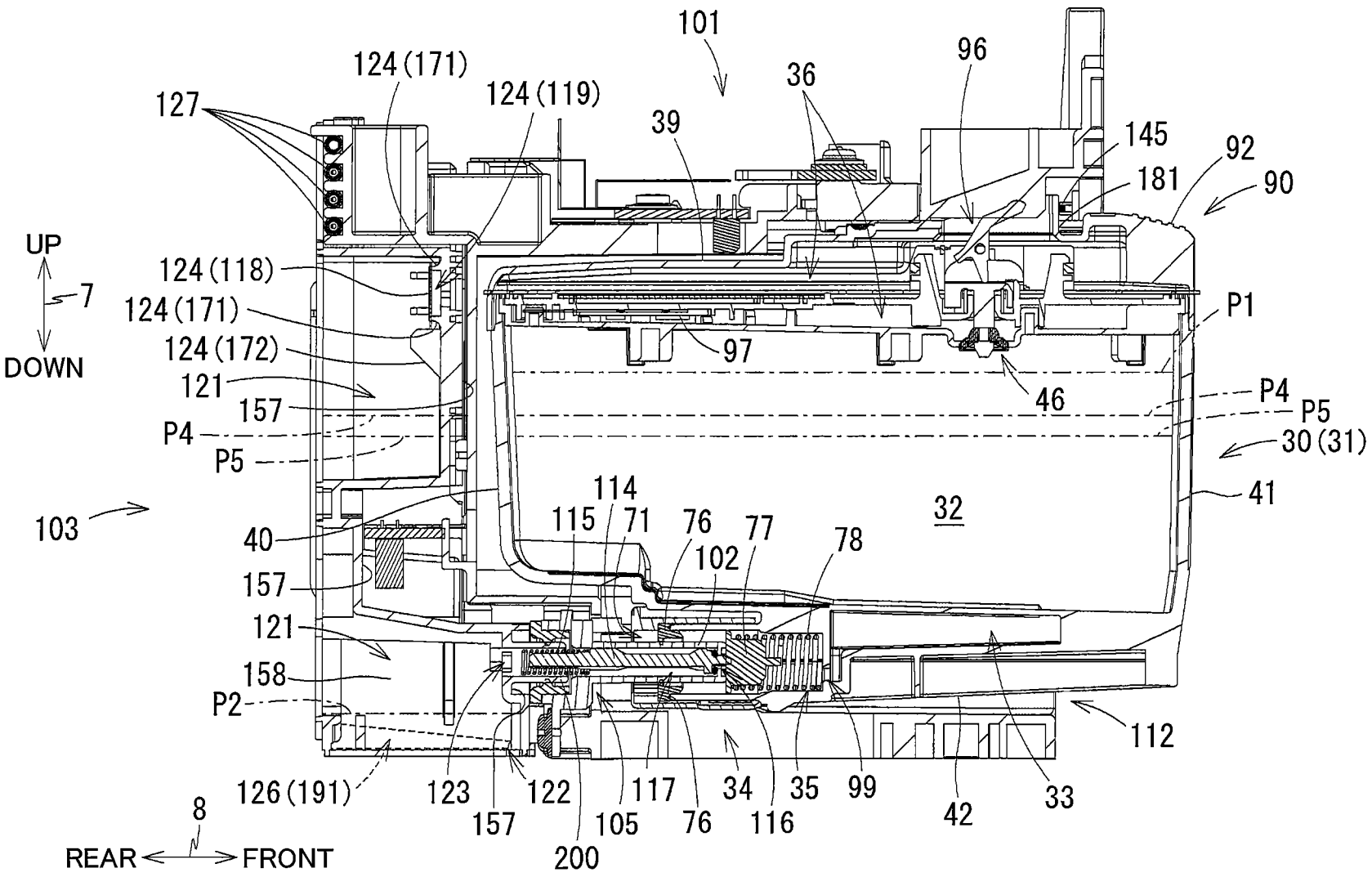
FIG. 11 is a vertical cross-sectional view illustrating a state where the ink cartridge 30 is attached to the case 101, and is connected to the tank 103 according to a modified embodiment.

For example, as illustrated in FIG. 11, assuming that the ink cartridge 30 where the maximum amount of ink is stored in the storage chambers 32, 33 and the ink valve chamber 35 (ink cartridge 30 where the level of the ink is at the position P1) is connected to the tank 103 where no ink is stored in the storage chamber 121, and no purge processing is performed during the ink supplying process in which the ink supplied. By this connection, the ink is supplied from the storage chambers 32, 33 and the ink valve chamber 35 to the storage chamber 121 by the water head difference, with the result that the level of the ink stored in the storage chambers 32, 33 and the ink valve chamber 35 becomes equal to the level of the ink stored in the storage chamber 121. In this state, the level of the ink stored in the storage chambers 32, 33 and the ink valve chamber 35 is at a position P4.

However, assuming that the ink cartridge 30 where the maximum amount of ink is stored in the storage chambers 32, 33 and the ink valve chamber 35 (ink cartridge 30 where the level of the ink is at the position P1) is connected to the tank 103 where no ink is stored in the storage chamber 121, and then purge processing is performed, and thereafter, the level of the ink stored in the storage chambers 32, 33 and the ink valve chamber 35 becomes equal to the level of the ink stored in the storage chamber 121 by the supply of the ink from the storage chambers 32, 33 and the ink valve chamber 35 to the storage chamber 121 due to the water head difference. In this state, the level of the ink stored in the storage chambers 32, 33 and the ink valve chamber 35 is at a position P5 (FIG. 11) lower than the position P4, since the ink has been sucked by the initial purge processing from the storage chambers 32, 33, the ink valve chamber 35, and the storage chamber 121 to the recording head 21.

Normally, when the multifunction peripheral 10 is used for the first time by a user, the ink cartridge 30 (e.g., ink cartridge 30 for initial introduction of ink) storing the maximum amount of ink in the storage chambers 32, 33 and the ink valve chamber 35 is connected to the tank 103 (e.g., a new tank 103) in which no ink is stored in the storage chamber 121. At this time, ink is supplied by the water head difference from the ink cartridge 30 to the tank 103, and ink sucking (initial purge processing) is executed by the purge mechanism 60. As a result, the ink stored in the storage chambers 32, 33, the ink valve chamber 35, and the storage chamber 121 is supplied to the recording head 21. According to the present modification, the initial purge processing is executed while the ink is supplied by the water head difference, and after the initial purge processing, ink is further supplied by the water head difference from the storage chambers 32, 33 and the ink valve chamber 35 to the storage chamber 121, so that the level of the ink stored in the storage chambers 32, 33 and the ink valve chamber 35 becomes equal to the level of the ink stored in the storage chamber 121. In this state, the semipermeable membrane 118 is positioned above the level (position P5) of the ink stored in the storage chambers 32, 33 and the ink valve chamber 35. This can reduce a possibility that the semipermeable membrane 118 gets wet due to contact with the ink. Thus, in a configuration where the initial purge processing is performed while the ink is supplied by the water head difference, the semipermeable membrane 118 may be disposed above the position P5. That is, the semipermeable membrane 118 may be positioned not only above the position P4 but also at a position below the position P4 and above the position P5.

In the modification 2, the position P5 may be higher than the level (position P3) of the ink upon completion of the ink supply by the water head difference in the modification 1. In this case, the position P5 in the modification 2 is the highest position of the level of the ink stored in the storage chamber 121 in normal use. For example, in a case where the capacity of ink cartridge 30 for use only in the initial introduction of ink is larger than the capacity of the ink cartridge 30 for use in cartridge replacement as in the modification 1, the position P5 is higher than the position P3. Thus, in this case, by positioning the semipermeable membrane 118 above the position P5, a possibility of wetting of the semipermeable membrane 118 due to contact with the ink can be reduced.

Modification 3

In the modification 2, the level of the ink at completion of the ink supply by the water head difference is at the position P5, and the semipermeable membrane 118 is positioned above the position P5. However, as illustrated in FIG. 11, the semipermeable membrane 118 may be positioned at a position P4 above the position P5. As described above, the level of the ink stored in the storage chambers 32, 33 and the ink valve chamber 35 is at the position P4 in a state where the ink cartridge 30 storing the maximum amount of ink is stored in the storage chambers 32, 33 and the ink valve chamber 35 (the level of the ink is at the position P1 in the ink cartridge 30) is connected to the tank 103 in which no ink is stored in the storage chamber 121 to start supply of the ink from the storage chambers 32, 33 and the ink valve chamber 35 to the storage chamber 121 by the water head difference, so that the level of the ink stored in the storage chambers 32, 33 becomes equal to the level of the ink stored in the storage chamber 121.

In the above modification 2, the initial purge processing is performed while the ink is supplied by the water head difference from the ink cartridge 30 to the tank 103. On the other hand, in the modification 3, the initial purge processing will be performed after the level of the ink stored in the storage chambers 32, 33 and the ink valve chamber 35 becomes equal to the level of the ink stored in the storage chamber 121 by the ink supply due to the water head difference. That is, after the level of the ink becomes at the position P4, the level of the ink is lowered to the position P5 by the initial purge processing.

Thus, in the modification 3, when the ink cartridge 30 (e.g., ink cartridge 30 for initial introduction of ink) storing the maximum amount of ink in the storage chambers 32, 33 and the ink valve chamber 35 is connected to the tank 103 (e.g., a new tank 103) in which no ink is stored in the storage chamber 121, the ink stored in the storage chambers 32, 33 and the ink valve chamber 35 is supplied by the water head difference to the storage chamber 121. This ink supply is continued until the level of the ink stored in the storage chamber 121 and the level of the ink stored in the storage chambers 32, 33 and the ink valve chamber 35 become equal to each other in height. According to the modification 3, when the ink supply is stopped (when the level of the ink stored in the storage chamber 121 becomes equal to the level of the ink stored in the storage chambers 32, 33 and the ink valve chamber 35), the semipermeable membrane 118 is positioned above the level (position P4) of the ink stored in the storage chambers 32, 33 and the ink valve chamber 35. This can reduce a possibility of wetting of the semipermeable membrane 118 due to contact with the ink.

In the modification 3, the position P4 may be above the position P3 in the modification 1 at completion of the ink supply by the water head difference. In this case, the position P4 in the modification 3 is the highest position of the level of the ink stored in the storage chamber 121 in normal use. For example, in a case where the ink cartridge 30 for use only in the initial introduction of ink is lager in volume than the ink cartridge 30 for use in cartridge replacement as in the modification 1, the position P4 is above the position P3. Thus, by disposing the semipermeable membrane 118 above the position P4, a possibility that the semipermeable membrane 118 gets wet due to contact with the ink can be reduced.

OTHER MODIFICATIONS

The shape of the ink cartridge 30 is not limited to that illustrated in FIG. 6, and the shape of the tank 103 is not limited to that illustrated in FIGS. 7 and 8. For example, the ink cartridge 30 may have a rectangular parallelepiped shape without the sub-lower wall 48 and the stepped surface 49. Further, the walls defining the outer shape of the tank 103 may extend in directions inclined with respect to the up-down direction 7, front-rear direction 8, and left-right direction 9.

In the above embodiment, the first rib 171 is formed on the front wall 157, and the semipermeable membrane 118 is welded to the first rib 171. However, the first rib 171 need not necessarily be formed on the front wall 157. In the latter case, the semipermeable membrane 118 may be welded to the rear surface 157A of the front wall 157.

In the above embodiment, the semipermeable membrane 118 is positioned on the rear surface 157A side of the front wall 157. However, the semipermeable membrane 118 need not necessarily be positioned on the rear surface 157A side of the front wall 157. For example, the semipermeable membrane 118 may be welded to the front surface 157B of the front wall 157. Further, for example, when the communication port 119 is formed on a wall other than the front wall 157 such as the upper wall 153, the right wall 155, the left wall 156, and the inner wall 158, the semipermeable membrane 118 may be welded to such wall other than the front wall 157.

In the above embodiment, the second ribs 172 are formed on the rear surface 157A of the front wall 157. However, the second ribs 172 may be dispensed with.

In the above embodiment, the air communication portion 124 has the communication port 119, the first rib 171, the semipermeable membrane 118, the second ribs 172, the labyrinth channel 120, and the air opening port 129. However, the air communication portion 124 may have at least the communication port 119 and semipermeable membrane 118 as long as the communication port 119 provides communication between the storage chamber 121 and the outside of the tank 103, and the semipermeable membrane 118 is welded to the communication port 119.

In the above embodiment, the air opening port 129 is formed in the front wall 157. However, the air opening port 129 may be formed in a wall other than the front wall 157 such as the upper wall 153, the right wall 155, the left wall 156, and the inner wall 158.

In the above-described embodiment, the tank 103 includes the tank body 151, the film 152A, and the film 152B, and the rear surface of the storage chamber 121 and the part of the ink channel 126 are defined by the film 152A. Further, the part of the labyrinth channel 120 is defined by the film 152B. However, the configuration of the tank 103 is not limited to this structure. For example, the tank 103 may be constituted by the tank body 151 and a single sheet of film. In the latter case, one of the surfaces (e.g., rear surface) defining the storage chamber 121, a part of the ink channel 126, and a part of the labyrinth channel 120 may be defined by the one sheet of film. Further, for example, two of the surfaces (e.g., left and right surfaces) defining the storage chamber 121 may each be defined by the single film.

In the above-described embodiment, the film 152A, the film 152B, and the semipermeable membrane 118 are bonded by welding to the tank body 151. However, they may be bonded to the tank body by an adhesive agent instead of welding.

In the above-described embodiment, the number of the ink cartridges 30 that can be attached to the multifunction peripheral 10 is four. However, the number of the ink cartridges 30 that can be attached to the multifunction peripheral 10 is not limited to four but may be any number. In this case, the multifunction peripheral 10 may be configured such that the number of spaces partitioned by the plates 104 in the case 101, the number of the storage chambers 121 of the tank 103, and the like are equal to the number of the ink cartridges 30 to be attached to the multifunction peripheral 10.

In the above-described embodiment, ink serves as an example of liquid. However, instead of ink, a pretreatment liquid that is ejected onto a recording sheet prior to ejection of the ink during an image forming operation may be used as liquid. Alternatively, water or other liquid to be sprayed in the vicinity of the nozzles 29 of the recording head 21 for preventing the nozzles 29 from drying may be used as liquid.

While the description has been made in detail with reference to the embodiments thereof, it would be apparent to those skilled in the art that many modifications and variations may be made therein without departing from the scope of the disclosure.

What is claimed is:

1. A liquid consumption device comprising:

a cartridge comprising:

a first storage chamber configured to store therein a liquid, and a first air communicating portion to allow the first storage chamber to communicate with an atmosphere, wherein the first air communicating portion is positioned above the first storage chamber;

a tank to which the cartridge is connectable, the tank comprising:

a second storage chamber configured to store therein the liquid flowing from the first storage chamber, at least a part of the second storage chamber being defined by a wall in which a communication port is formed;

a second air communicating portion to allow the second storage chamber to communicate with the atmosphere through the communication port; and a semipermeable membrane covering the communication port and configured to block the liquid and allow the air to pass therethrough; and a consumption portion configured to consume the liquid supplied from the second storage chamber;

wherein the semipermeable membrane is positioned above a level of the liquid stored in the first storage chamber in a state where the level of the liquid stored in the first storage chamber becomes equal to the level of the liquid stored in the second storage chamber because of a flow of the liquid from the first storage chamber to the second storage chamber due to water head difference as a result of the connection of the cartridge to the tank, the first storage chamber of the cartridge to be connected to the tank storing therein a maximum amount of liquid, and wherein the semipermeable membrane has a portion whose height is equal to that of the first air communicating portion.

2. The liquid consumption device according to claim 1, wherein the semipermeable membrane is positioned above the level of the liquid stored in the first storage chamber storing therein the maximum amount of the liquid in a state where the cartridge is connected to the tank.

3. The liquid consumption device according to claim 2, wherein the semipermeable membrane is positioned below an upper end of the cartridge.

4. The liquid consumption device according to claim 1, wherein the tank has:

an inlet through which the liquid flows from the first storage chamber into the second storage chamber; and an outlet positioned below the inlet and through which the liquid is discharged from the second storage chamber;

wherein the semipermeable membrane is positioned above the level of the liquid stored in the first storage chamber in the state where the level of the liquid stored in the first storage chamber becomes equal to the level of the liquid stored in the second storage chamber because of the flow of the liquid from the first storage chamber to the second storage chamber due to water head difference as the result of the connection of the cartridge whose first storage chamber stores therein the maximum amount of liquid to the tank whose second storage chamber stores therein the liquid whose level is positioned between the inlet and the outlet.

5. The liquid consumption device according to claim 1, wherein the semipermeable membrane is positioned above the level of the liquid stored in the first storage chamber in the state where the level of the liquid stored in the first storage chamber becomes equal to the level of the liquid stored in the second storage chamber because of the flow of the liquid from the first storage chamber to the second storage chamber due to water head difference as the result of the connection of the cartridge whose first storage chamber stores therein the maximum amount of liquid to the tank whose second storage chamber stores therein no liquid.

6. The liquid consumption device according to claim 1, wherein the wall extends in a vertical direction.

7. The liquid consumption device according to claim 1, wherein the wall has a first surface facing the second storage chamber, the semipermeable membrane being positioned at the first surface.

8. The liquid consumption device according to claim 7, wherein the tank has a first rib provided at the first surface and surrounding the communication port, the semipermeable membrane being stuck to the first rib.

9. The liquid consumption device according to claim 1, further comprising a film stuck to the tank at a position facing the wall, the film defining at least a part of the second storage chamber.

10. The liquid consumption device according to claim 1, wherein the consumption portion is a head including a nozzle through which the liquid supplied from the second storage chamber is ejectable.

11. A liquid consumption device comprising:

a cartridge comprising:

a first storage chamber configured to store therein a liquid, and a first air communicating portion to allow the first storage chamber to communicate with an atmosphere;

a tank to which the cartridge is connectable, the tank comprising:

a second storage chamber configured to store therein the liquid flowing from the first storage chamber, at least a part of the second storage chamber being defined by a wall in which a communication port is formed;

a second air communicating portion to allow the second storage chamber to communicate with the atmosphere through the communication port; and a semipermeable membrane covering the communication port and configured to block the liquid and allow the air to pass therethrough; and a consumption portion configured to consume the liquid supplied from the second storage chamber;

wherein the semipermeable membrane is positioned above a level of the liquid stored in the first storage chamber in a state where the level of the liquid stored in the first storage chamber becomes equal to the level of the liquid stored in the second storage chamber because of a flow of the liquid from the first storage chamber to the second storage chamber due to water head difference as a result of the connection of the cartridge to the tank, the first storage chamber of the cartridge to be connected to the tank storing therein a maximum amount of liquid, wherein the wall has a first surface facing the second storage chamber, the semipermeable membrane being positioned at the first surface, wherein the tank has a first rib provided at the first surface and surrounding the communication port, the semipermeable membrane being stuck to the first rib, and wherein the tank further has a second rib positioned below the first rib and in abutment with a lower end of the semipermeable membrane.

12. A liquid consumption device comprising:

a cartridge comprising:

a first storage chamber configured to store therein a liquid, and a first air communicating portion to allow the first storage chamber to communicate with an atmosphere;

a tank to which the cartridge is connectable, the tank comprising:

a second storage chamber configured to store therein the liquid flowing from the first storage chamber, at least a part of the second storage chamber being defined by a wall in which a communication port is formed, wherein the wall has a second surface opposite to the second storage chamber with respect to the first surface;

a second air communicating portion to allow the second storage chamber to communicate with the atmosphere through the communication port; and a semipermeable membrane covering the communication port and configured to block the liquid and allow the air to pass therethrough; and a consumption portion configured to consume the liquid supplied from the second storage chamber;

wherein the semipermeable membrane is positioned above a level of the liquid stored in the first storage chamber in a state where the level of the liquid stored in the first storage chamber becomes equal to the level of the liquid stored in the second storage chamber because of a flow of the liquid from the first storage chamber to the second storage chamber due to water head difference as a result of the connection of the cartridge to the tank, the first storage chamber of the cartridge to be connected to the tank storing therein a maximum amount of liquid, and wherein the second air communicating portion has a labyrinth channel formed on the second surface and having a labyrinth structure, and an air opening port in communication with an outside of the tank, the labyrinth channel having one end in communication with the communication port, and another end in communication with the air opening port.

13. The liquid consumption device according to claim 12, wherein the air opening port is formed in the wall.

* * * * *